US011200867B1

(12) United States Patent
Yang et al.

(10) Patent No.: US 11,200,867 B1
(45) Date of Patent: Dec. 14, 2021

(54) DYNAMIC UNIFORMITY COMPENSATION FOR ELECTRONIC DISPLAY

(71) Applicant: Apple Inc., Cupertino, CA (US)

(72) Inventors: Maofeng Yang, San Jose, CA (US); Shengkui Gao, San Jose, CA (US); Paolo Sacchetto, Cupertino, CA (US); Weijun Yao, Saratoga, CA (US); Yongjun Li, Fremont, CA (US); Jiayi Jin, Redwood City, CA (US); Pyungwoo Yeon, Atlanta, GA (US); Michael Hong Yeol Lim, Cupertino, CA (US); Peter F. Holland, Los Gatos, CA (US); Ross Thompson, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/563,622

(22) Filed: Sep. 6, 2019

Related U.S. Application Data

(60) Provisional application No. 62/728,648, filed on Sep. 7, 2018.

(51) Int. Cl.

| | |
|---|---|
| ***G09G 5/10*** | (2006.01) |
| *G09G 3/34* | (2006.01) |
| *G09G 3/36* | (2006.01) |
| *G09G 3/32* | (2016.01) |

(52) U.S. Cl.
CPC ..... *G09G 5/10* (2013.01); *G09G 3/32* (2013.01); *G09G 3/346* (2013.01); *G09G 3/36* (2013.01); *G09G 2320/0233* (2013.01); *G09G 2320/0646* (2013.01)

(58) Field of Classification Search
CPC .... G09G 5/10; G09G 3/32; G09G 2320/0646; G09G 2320/0233
See application file for complete search history.

(56) References Cited

U.S. PATENT DOCUMENTS

| | | | | |
|---|---|---|---|---|
| 9,812,071 | B2 * | 11/2017 | Matsui | G09G 3/3413 |
| 2006/0262147 | A1 * | 11/2006 | Kimpe | G09G 3/20 345/690 |
| 2010/0123699 | A1 | 5/2010 | Leon et al. | |
| 2014/0375704 | A1 * | 12/2014 | Bi | G09G 3/3233 345/694 |
| 2017/0122725 | A1 | 5/2017 | Yeoh et al. | |
| 2018/0246375 | A1 | 8/2018 | Zhang | |
| 2018/0366074 | A1 | 12/2018 | Choi et al. | |
| 2019/0066555 | A1 | 2/2019 | Gu et al. | |
| 2019/0340980 | A1 | 11/2019 | Yum et al. | |
| 2020/0058252 | A1 | 2/2020 | Kim et al. | |
| 2020/0184912 | A1 * | 6/2020 | Wang | G09G 3/36 |

* cited by examiner

*Primary Examiner* — Liliana Cerullo
(74) *Attorney, Agent, or Firm* — Fletcher Yoder, P.C.

(57) ABSTRACT

A system may include an electronic display panel having pixels, where each pixel emits light based on a respective programming signal applied to the pixel. The system may also include processing circuitry to determine a respective control signal upon which the respective programing signal for each pixel is based. The processing circuitry may determine each respective control signal based at least in part on approximations of respective pixel brightness-to-data relationship as defined by a function having variables stored in memory accessible to the processing circuitry.

15 Claims, 29 Drawing Sheets

DYNAMIC UNIFORMITY COMPENSATION FOR ELECTRONIC DISPLAY

CROSS REFERENCE TO RELATED APPLICATIONS

This application claims priority to U.S. Provisional Patent Application No. 62/728,648, entitled "Dynamic Uniformity Compensation for Electronic Display," filed Sep. 7, 2018, and is related to U.S. patent application Ser. No. 16/563,610, filed Sep. 6, 2019, entitled "Dynamic Uniformity Compensation for Electronic Display," both of which are incorporated herein by reference in their entireties for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

This disclosure relates to compensating for non-uniform properties of pixels of an electronic display using a function derived in part by measuring light emitted by a pixel. Electronic displays are found in numerous electronic devices, from mobile phones to computers, televisions, automobile dashboards, and many more. Individual pixels of the electronic display may collectively produce images by permitting different amounts of light to be emitted from each pixel. This may occur by self-emission as in the case of light-emitting diodes (LEDs), such as organic light-emitting diodes (OLEDs), or by selectively providing light from another light source as in the case of a digital micromirror device (DMD) or liquid crystal display (LCD). These electronic displays sometimes do not emit light equally between pixels or groups of pixels of the electronic display. This may be due at least in part to non-uniform properties associated with the pixels caused by differences in component age, operating temperatures, material properties of pixel components, and the like. The non-uniform properties between pixels and/or portions of the electronic display may manifest as visual artifacts since different pixels and/or portions of the electronic display emit visibly different (e.g., perceivable by a user) amounts of light.

Systems and methods that compensate for non-uniform properties between pixels or groups of pixels of an electronic display may substantially improve the visual appearance of an electronic display by reducing perceivable visual artifacts. The systems to perform the compensation may be external to an electronic display and/or an active area of the electronic display, in which case they may be understood to provide a form of external compensation, or the systems to perform the compensation may be located within the electronic display (e.g., in a display driver integrated circuit). The compensation may take place in a digital domain or an analog domain, the net result of the compensation producing a compensated data signal (e.g., programming voltage, programming current) transmitted to each pixel of the electronic display before the data signal is used to cause the pixel to emit light. Because the compensated data signal has been compensated to account for the non-uniform properties of the pixels, the images resulting from compensated data signals to the pixels may have substantially reduced visual artifacts. Visual artifacts due to non-uniform properties of the pixels may be reduced or eliminated.

Indeed, this disclosure describes compensation techniques that use a per-pixel function to leverage a relatively small number of variables to predict a brightness-to-data relationship. In this disclosure, the brightness-to-data relationship is generally referred to a brightness-to-voltage (Lv-V) relationship, which is the case when the data signal is a voltage signal. However, the brightness-to-data relationship may also be used when the data signal represents a current (e.g., a brightness-to-current relationship (Lv-I)) or a power (e.g., a brightness-to-power relationship (Lv-W)). It should be appreciated that further references to brightness-to-voltage (Lv-V) are intended to also apply to any suitable brightness-to-data relationship, such as a brightness-to-current relationship (Lv-I), brightness-to-power relationship (Lv-W), or the like. The predicted brightness-to-data relationship may be expressed as a curve, which may facilitate determining the appropriate data signal to transmit to the pixel to cause emission at a target brightness level of light. In addition, some examples may include a regional or global adjustment to further correct non-uniformities of the electronic display.

A controller may apply the brightness-to-data relationship of a pixel or group of pixels to improve perceivable visual appearances of the electronic display by changing a data signal used to drive that pixel or by changing the data signals used to drive that group of pixels. The brightness-to-data relationship may reduce or eliminate perceivable non-uniformity between pixels or groups of pixels.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
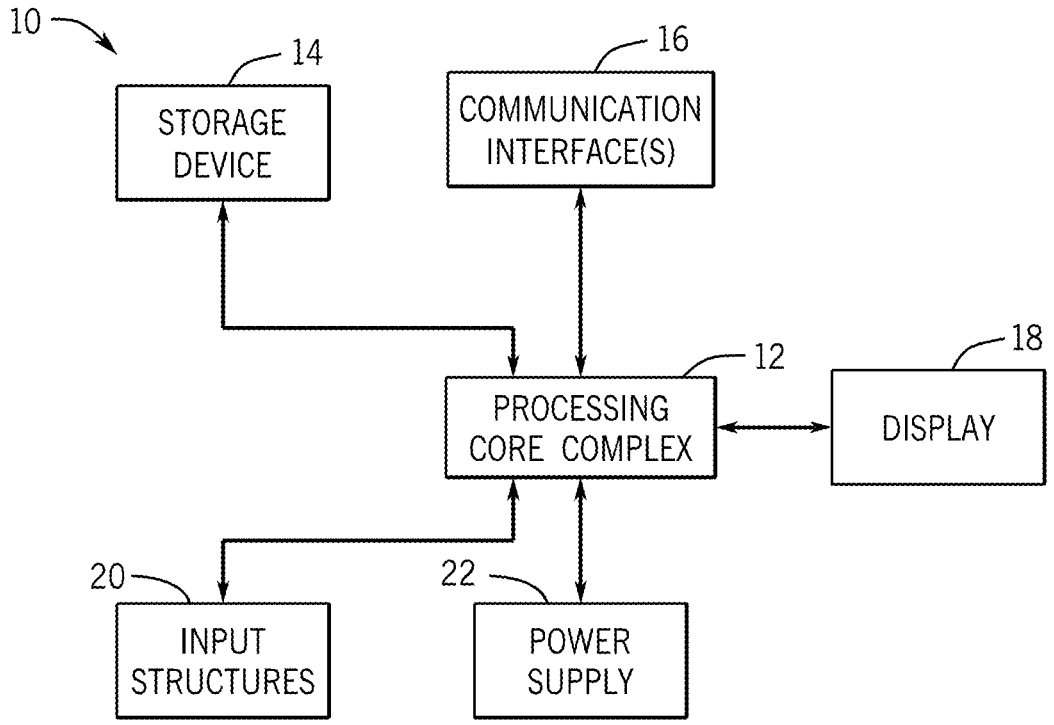
FIG. 1 is a schematic block diagram of an electronic device, in accordance with an embodiment.

One or more specific embodiments are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to systems and methods that compensate non-uniform properties between pixels of an electronic display to improve perceived appearances of visual artifacts. Electronic displays may include light-modulating pixels, which may be light-emitting in the case of light-emitting diode (LEDs), such as organic light-emitting diodes (OLEDs), but may selectively provide light from another light source as in the case of a digital micromirror device (DMD) or liquid crystal display (LCD). While this disclosure generally refers to self-emissive displays, it should be appreciated that the systems and methods of this disclosure may also apply to other forms of electronic displays that have non-uniform properties of pixels causing varying brightness versus voltage relationships (Lv-V curves), and should not be limited to self-emissive displays. When the electronic display is a self-emissive display, an OLED represents one type of LED that may be found in a self-emissive pixel, but other types of LEDs may also be used.

The systems and methods of this disclosure may compensate for non-uniform properties between pixels. This may improve the visual appearance of images on the electronic display. The systems and methods may also improve a response by the electronic display to changes in operating conditions, such as temperature, by enabling a controller to accurately predict performance of individual pixels of the electronic display without tracking and recording numerous data points of pixel behavior to determine Lv-V curves. Instead, a controller may store a few variables, or extracted parameters, for each pixel or group of pixels that, when used in a function (e.g., per-pixel function or per-region function), may generally produce the Lv-V curve of each respective pixel. This reduces a reliance on large numbers of stored data points for all of the pixels of the electronic display, saving memory and/or computing or processing resources. In addition to the controller using a relatively small number of per-pixel or per-region variables, some embodiments may include a further compensation may be applied on a regional or global basis. By at least using the per-pixel function, the Lv-V curves for each pixel in the electronic display may be estimated without relying on large amounts of stored test data. Using the estimated Lv-V curves defined by the per-pixel function, image data that is to be displayed on the electronic display may be compensated before it is programmed into each pixel. The resulting images may have reduced or eliminated visual artifacts due to Lv-V non-uniformities among the pixels.

Furthermore, in some examples, a map used to generate each per-pixel function may be created at a particular brightness level of the display. For example, the map may be generated during manufacturing of the electronic device as part of a display calibration operation and may include data corresponding to one or more captured images. To generate the map, image capturing devices may capture an image of the display at a particular brightness level. In some cases, the per-pixel functions that result from the generated map may be optimally applied at the particular brightness level and less optimally applied at a brightness level not within a range of deviation from the particular brightness level or not at the particular brightness level. As will be appreciated, generating several maps at different brightness levels during calibration and selecting which map to reference to obtain relevant per-pixel functions may improve compensation operations of the electronic device. For example, a particular map may be selected from a group of maps in response to real-time operating conditions of the display (e.g., an input brightness value), and be used to derive per-pixel functions associated with the real-time operating condition. Improvements to compensation operations may improve an appearance of the display, such as by making the display appear relatively more uniform.

A general description of suitable electronic devices that may include a self-emissive display, such as a LED (e.g., an OLED) display, and corresponding circuitry of this disclosure are provided. FIG. 1 is a block diagram of one example of a suitable electronic device 10 may include, among other things, a processing core complex 12 such as a system on a chip (SoC) and/or processing circuit(s), a storage device 14, communication interface(s) 16, a display 18, input structures 20, and a power supply 22. The blocks shown in FIG. 1 may each represent hardware, software, or a combination of both hardware and software. The electronic device 10 may include more or fewer elements. It should be appreciated that FIG. 1 merely provides one example of a particular implementation of the electronic device 10.

The processing core complex 12 of the electronic device 10 may perform various data processing operations, including generating and/or processing image data for presentation on the display 18, in combination with the storage device 14. For example, instructions that are executed by the processing core complex 12 may be stored on the storage device 14. The storage device 14 may be volatile and/or non-volatile memory. By way of example, the storage device 14 may include random-access memory, read-only memory, flash memory, a hard drive, and so forth.

The electronic device 10 may use the communication interface(s) 16 to communicate with various other electronic devices or elements. The communication interface(s) 16 may include input/output (I/O) interfaces and/or network interfaces. Such network interfaces may include those for a personal area network (PAN) such as Bluetooth, a local area network (LAN) or wireless local area network (WLAN) such as Wi-Fi, and/or for a wide area network (WAN) such as a cellular network.

Using pixels containing LEDs (e.g., OLEDs), the display 18 may show images generated by the processing core complex 12. The display 18 may include touchscreen functionality for users to interact with a user interface appearing on the display 18. Input structures 20 may also enable a user to interact with the electronic device 10. In some examples, the input structures 20 may represent hardware buttons, which may include volume buttons or a hardware keypad. The power supply 22 may include any suitable source of power for the electronic device 10. This may include a battery within the electronic device 10 and/or a power conversion device to accept alternating current (AC) power from a power outlet.

Figure 2:
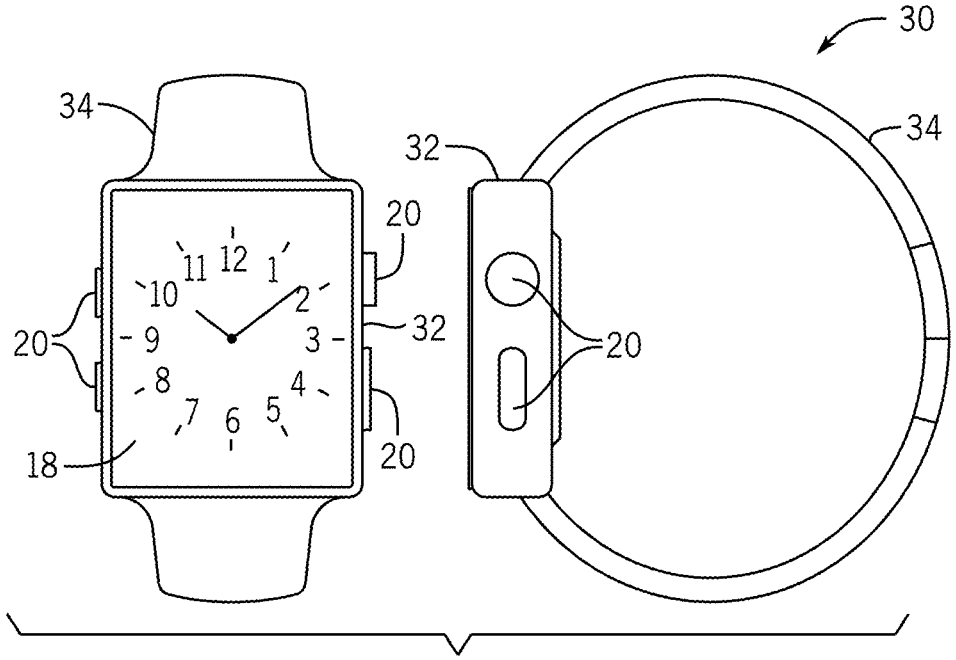
FIG. 2 is a perspective view of a watch representing an embodiment of the electronic device of FIG. 1, in accordance with an embodiment.

As may be appreciated, the electronic device 10 may take a number of different forms. As shown in FIG. 2, the electronic device 10 may take the form of a watch 30. For illustrative purposes, the watch 30 may be any Apple Watch® model available from Apple Inc. The watch 30 may include an enclosure 32 that houses the electronic device 10 elements of the watch 30. A strap 34 may enable the watch 30 to be worn on the arm or wrist. The display 18 may display information related to the watch 30 operation, such as the time. Input structures 20 may enable a person wearing the watch 30 to navigate a graphical user interface (GUI) on the display 18.

Figure 3:
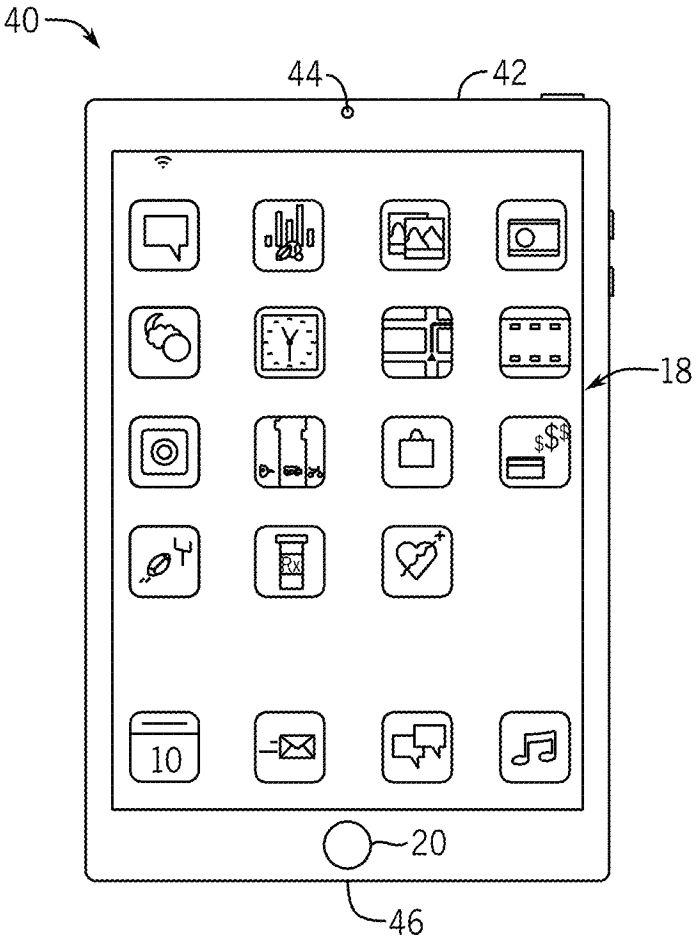
FIG. 3 is a front view of a tablet device representing an embodiment of the electronic device of FIG. 1, in accordance with an embodiment.

The electronic device 10 may also take the form of a tablet device 40, as is shown in FIG. 3. For illustrative purposes, the tablet device 40 may be any iPad® model available from Apple Inc. Depending on the size of the tablet device 40, the tablet device 40 may serve as a handheld device such as a mobile phone. The tablet device 40 includes an enclosure 42 through which input structures 20 may protrude. In certain examples, the input structures 20 may include a hardware keypad (not shown). The enclosure 42 also holds the display 18. The input structures 20 may enable a user to interact with a GUI of the tablet device 40. For example, the input structures 20 may enable a user to type a Rich Communication Service (RCS) message, a Short Message Service (SMS) message, or make a telephone call. A speaker 44 may output a received audio signal and a microphone 46 may capture the voice of the user. The tablet device 40 may also include a communication interface 16 to enable the tablet device 40 to connect via a wired connection to another electronic device.

Figure 4:
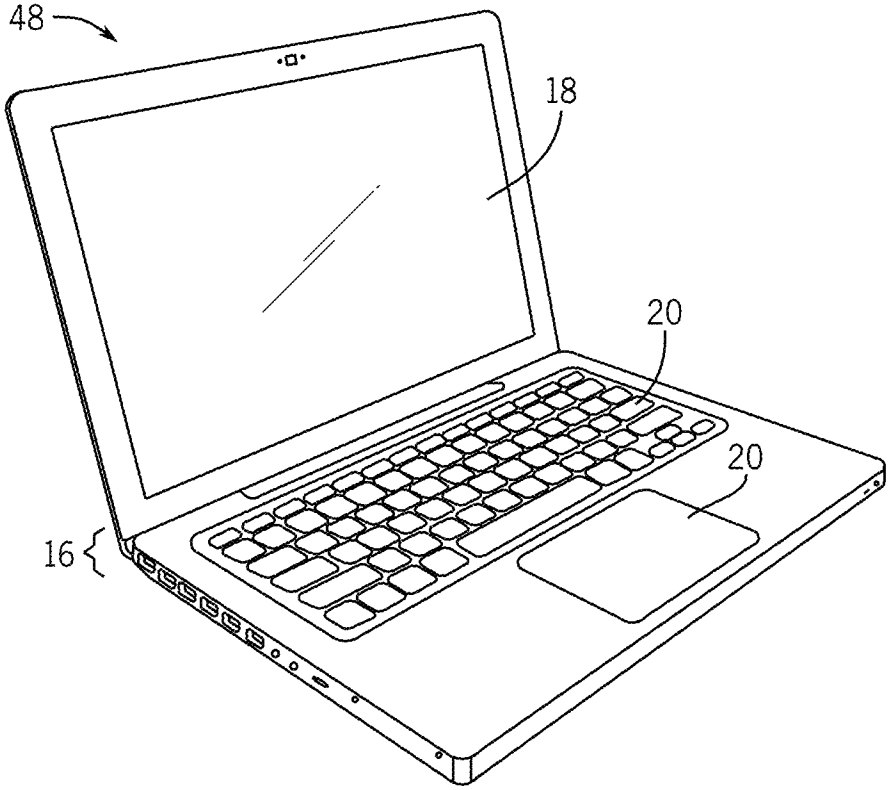
FIG. 4 is a front view of a computer representing an embodiment of the electronic device of FIG. 1, in accordance with an embodiment.

A computer 48 represents another form that the electronic device 10 may take, as shown in FIG. 4. For illustrative purposes, the computer 48 may be any Macbook® or iMac® model available from Apple Inc. It should be appreciated that the electronic device 10 may also take the form of any other computer, including a desktop computer. The computer 48 shown in FIG. 4 includes the display 18 and input structures 20, such as in the form of a keyboard and a track pad. Communication interfaces 16 of the computer 48 may include, for example, a universal service bus (USB) connection.

Figure 5:
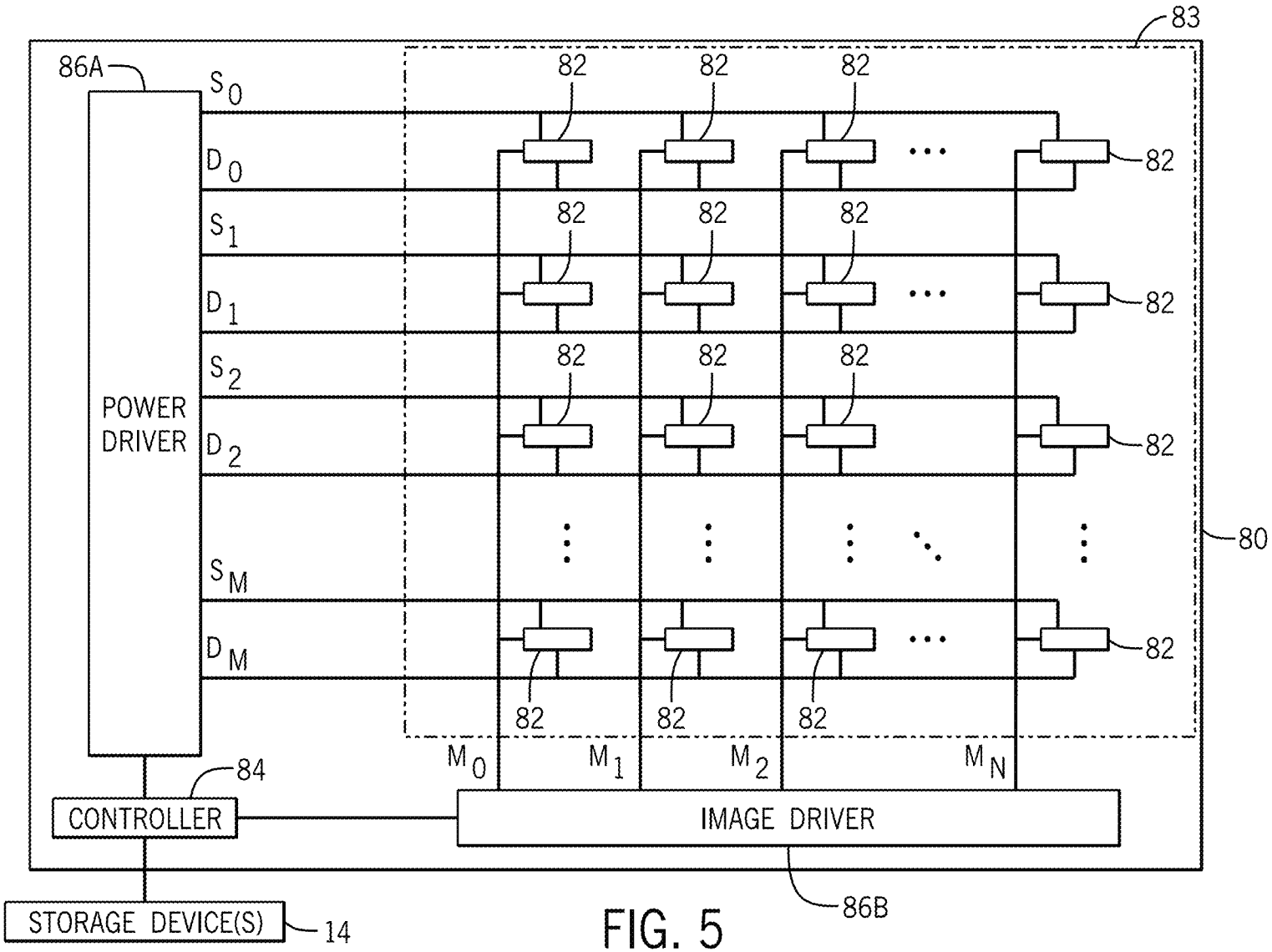
FIG. 5 is a circuit diagram of the display of the electronic device of FIG. 1, in accordance with an embodiment.

As shown in FIG. 5, the display 18 may include a pixel array 80 having an array of one or more pixels 82 within an active area 83. The display 18 may include any suitable circuitry to drive the pixels 82. In the example of FIG. 5, the display 18 includes a controller 84, a power driver 86A, an image driver 86B, and the array of the pixels 82. The power driver 86A and image driver 86B may drive individual of the pixels 82. In some cases, the power driver 86A and the image driver 86B may include multiple channels for independent driving of multiple pixels 82. Each of the pixels 82 may include any suitable light-emitting element, such as a LED, one example of which is an OLED. However, any other suitable type of pixel may also be used. Although the controller 84 is shown in the display 18, the controller 84 may sometimes be located outside of the display 18. For example, the controller 84 may be at least partially located in the processing core complex 12.

The scan lines S0, S1, . . . , and Sm and driving lines D0, D1, . . . , and Dm may connect the power driver 86A to the pixel 82. The pixel 82 may receive on/off instructions through the scan lines S0, S1, . . . , and Sm and may receive programming voltages corresponding to data voltages transmitted from the driving lines D0, D1, . . . , and Dm. The programming voltages may be transmitted to each of the pixel 82 to emit light according to instructions from the image driver 86B through driving lines M0, M1, . . . , and Mn. Both the power driver 86A and the image driver 86B may transmit voltage signals as programmed voltages (e.g., programming voltages) through respective driving lines to operate each pixel 82 at a state determined by the controller 84 to emit light. Each driver may supply voltage signals at a duty cycle and/or amplitude sufficient to operate each pixel 82.

The intensities of each pixel 82 may be defined by corresponding image data that defines particular gray levels for each of the pixels 82 to emit light. A gray level indicates a value between a minimum and a maximum range, for example, 0 to 255, corresponding to a minimum and maximum range of light emission. Causing the pixels 82 to emit light according to the different gray levels causes an image to appear on the display 18. In this way, a first brightness level of light (e.g., at a first luminosity and defined by a gray level) may emit from a pixel 82 in response to a first value of the image data and the pixel 82 may emit at a second brightness level of light (e.g., at a first luminosity) in response to a second value of the image data. Thus, image data may facilitate creating a perceivable image output by indicating light intensities to be generated via a programmed data signal to be applied to individual pixels 82.

The controller 84 may retrieve image data stored in the storage device 14 indicative of various light intensities. In some examples, the processing core complex 12 may provide image data directly to the controller 84. The controller 84 may control the pixel 82 by using control signals to control elements of the pixel 82. The pixel 82 may include any suitable controllable element, such as a transistor, one example of which is a metal-oxide-semiconductor field-effect transistor (MOSFET). However, any other suitable type of controllable elements, including thin film transistors (TFTs), p-type and/or n-type MOSFETs, and other transistor types, may also be used.

Figure 6:
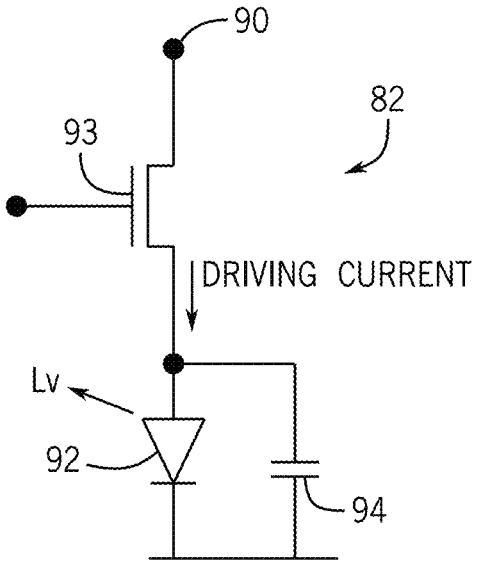
FIG. 6 is a circuit diagram of a pixel of the display of FIG. 5, in accordance with an embodiment.

FIG. 6 is a circuit diagram of an example of the described pixel 82. The pixel 82 depicted in FIG. 6 includes a terminal 90 to receive a driving current generated in response to a programming voltage programmed in response to the image data to be displayed. While the pixel 82 of FIG. 6 receives a data signal in the form a programming voltage, other examples of pixels 82 may receive a data signal in the form of a programming current or programming power. It should be understood that this disclosure is not meant to be limited only to pixels that receive programming voltages. Indeed, this disclosure also may be used for pixels of DMD, LCD, or plasma displays, or any other type of electronic display that may have non-uniform brightness-to-data relationships across pixels or groups of pixels. Returning to FIG. 6, the controller 84 may use the programming voltage and transmitted control signals to control the luminance, also sometimes referred to as brightness, of light (Lv) emitted from the pixel 82. It should be noted that luminance and brightness are terms that refer to an amount of light emitted by a pixel 82 and may be defined using units of nits (e.g., candela/$m^2$) or using units of lumens. The programming voltage may be selected by a controller 84 to cause a particular luminosity of light emission (e.g., brightness level of light emitted, measure of light emission) from a light-emitting diode (LED) 92 (e.g., an organic light-emitting diode (OLED)) of the self-emissive pixel 82 or other suitable light-emitting element.

The programming voltage is applied to a transistor 93, causing a driving current to be transmitted through the transistor 93 onto the LED 92 based on the Lv-V curve characteristics of the transistor 93 and/or the LED 92. The transistor 93 may be any suitable transistor, such as in one example, an oxide thin film transistor (TFT). In this way, the light emitted from the LED 92 may be selectively controlled. When the Lv-V curve characteristics differ between two pixels 82, perceived brightness of different pixels 82 may appear non-uniform—meaning that one pixel 82 may appear as brighter than a different pixel 82 even when both are programmed by the same programming voltage. The controller 84 or the processing core complex 12 may compensate for these non-uniformities if the controller 84 or the processing core complex 12 are able to accurately predict the Lv-V behavior of the pixel 82. If the controller 84 or the processing core complex 12 are able to make the prediction, the controller 84 or the processing core complex 12 may determine what programming voltage to apply to the pixel 82 to compensate for differences in the brightness levels of light emitted between pixels 82.

Also depicted in FIG. 6 is a parasitic capacitance 94 of the LED 92. In some examples, a leakage current of the transistor 93 may continuously charge an anode of the LED 92 (e.g., the parasitic capacitance 94) such that the anode voltage approaches a turn-on voltage (e.g., a threshold voltage) for the LED 92. Once the anode voltage is equal to or greater than the turn-on voltage for the LED 92, the LED 92 emits light based on the value of driving current transmitted through the LED 92.

Figure 7A:
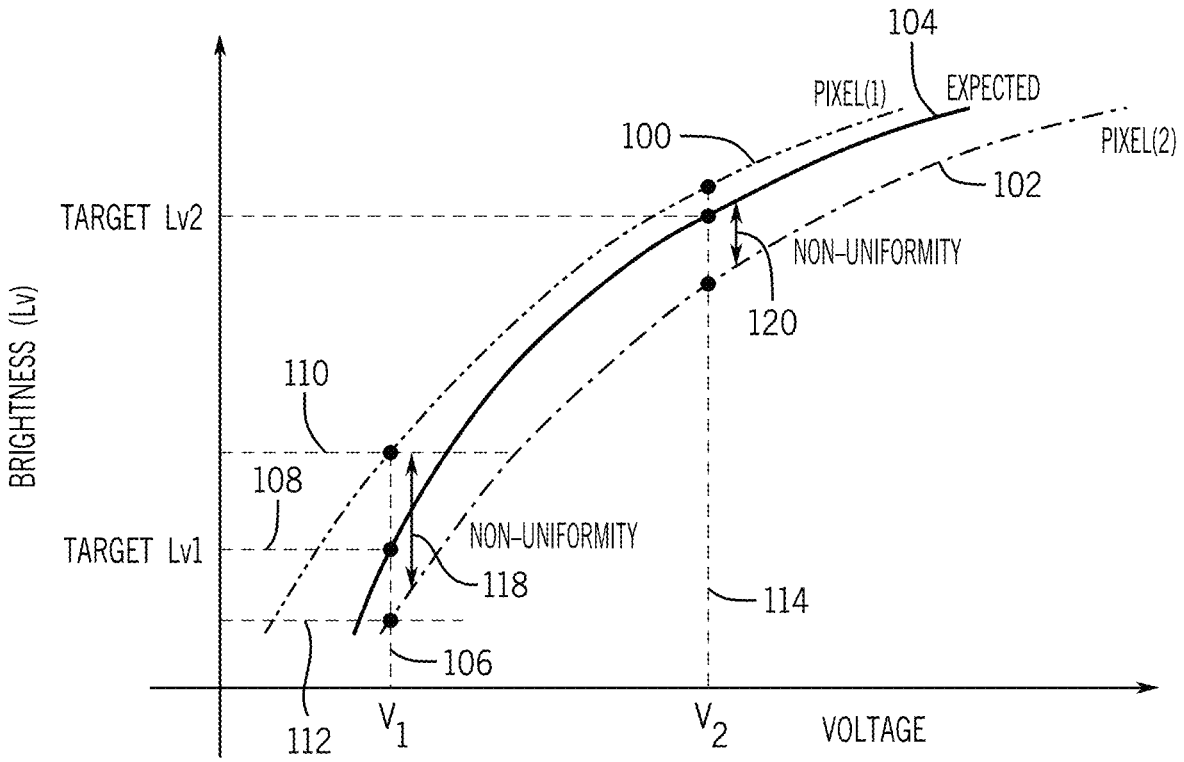
FIG. 7A is a graph of brightness-to-voltage (Lv-V) curves corresponding to pixels of the display of FIG. 5, in accordance with an embodiment.

To help illustrate non-uniform Lv-V curves, FIG. 7A is a graph of an Lv-V curve of a first pixel 82 (e.g., line 100) and an Lv-V curve of a second pixel 82 (e.g., line 102). These two Lv-V curves represent an example relationship between programming voltages (Vdata) used to drive the respective pixel 82 and the light emitted from the pixel 82 in response to the programming voltage. An Lv-V curve may be used by a controller to predict what amount of programming voltage to transmit to a pixel 82 to cause a light emission at a brightness level indicated by image data. Because these Lv-V curves are used to determine the programming voltage, deviations (e.g., non-uniformities) in the Lv-V curve from an expected response of the pixels 82 (e.g., line 104) may manifest as perceivable visual artifacts. The deviations shown in the graph between the line 100 and the line 104, in addition to the line 102 and the line 104, may be caused by non-uniform properties between various pixels 82 or regions of pixels 82.

During operation, a programming voltage is transmitted to a pixel 82 in response to image data to cause the pixel 82 to emit light at a brightness level to suitably display an image. This programming voltage is transmitted to pixels 82 to cause an expected response (e.g., a first programming voltage level is used specifically to cause a first brightness level to display an image). The expected response of the pixels 82 to a first voltage (V1) level 106 is a first brightness (Lv1) level 108, however, both responses from the first pixel 82 and the second pixel 82 deviate from that expected response (e.g., line 104). As illustrated on the graph, the first pixel 82 indicated by the line 100 responds by emitting a brightness level corresponding to brightness level 110 while the second pixel 82 indicated by the line 102 responds by emitting a brightness level 112. Both the brightness level 110 and the brightness level 112 deviate from the target brightness level of 108. This deviation between the Lv-V curves may affect the whole relationship, including the responses to a second voltage (V2) level 114 as illustrated on the graph. It should be noted that, in some cases, the pixel non-uniformity caused at least in part by the Lv-V curves is worse at lower programming voltages than higher programming voltages (e.g., net disparity 118 at a lower voltage is greater than net disparity 120 at a higher voltage).

Figure 7B:
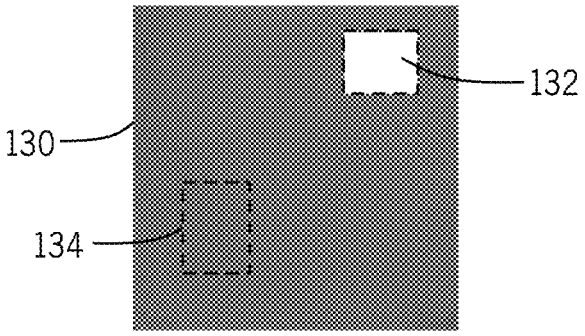
FIG. 7B is an illustration of non-uniform light emitted between pixels of the display of FIG. 5 without any compensation, in accordance with an embodiment.

FIG. 7B is an illustration depicting how the above-described non-uniformities between the Lv-V curves may manifest as visual artifacts on the display 18. This representation of a display panel 130 shows a portion 132 as different from a portion 134. The differences between the portion 132 and the portion 134 may be caused by material differences in transistors, for example, the transistor 93 or other transistors in a pixel 82.

Figure 8A:
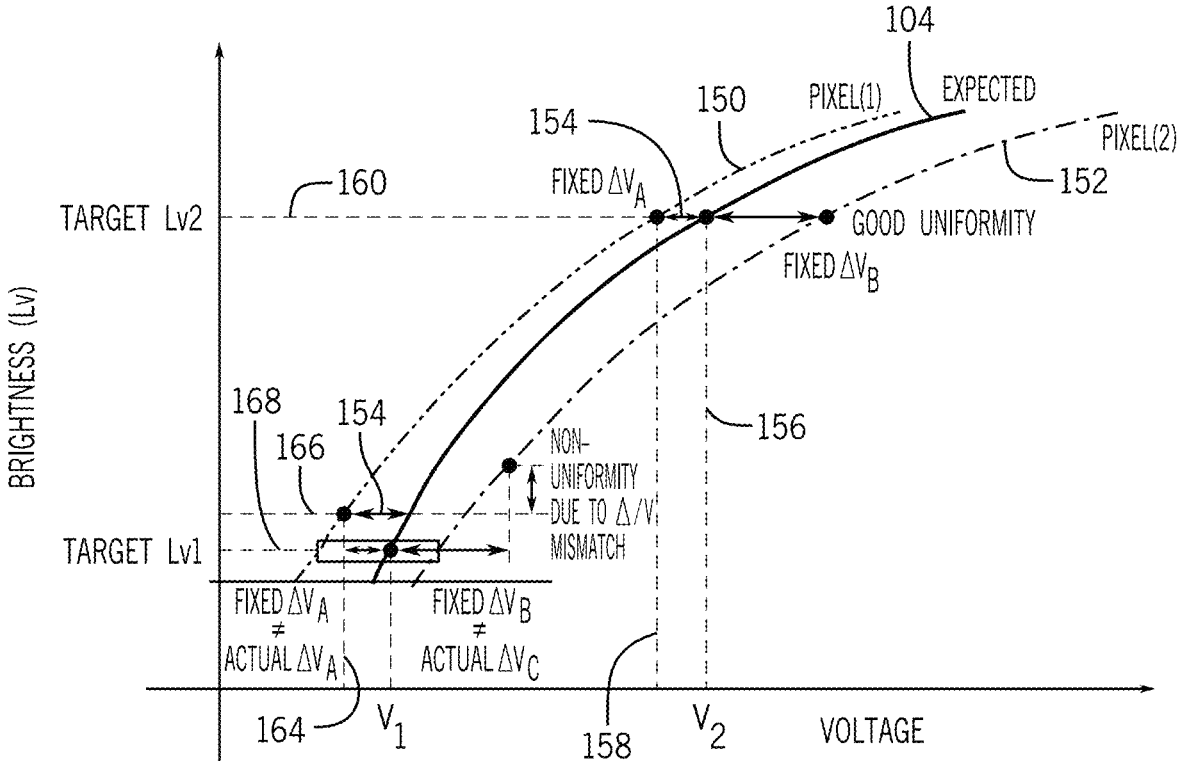
FIG. 8A is a graph of brightness-to-voltage (Lv-V) curves corresponding to pixels of the display of FIG. 5 including a depiction of a fixed correction, in accordance with an embodiment.

To correct for these non-uniformities, such as the differences between the portion 132 and the portion 134, a fixed correction may be used. FIG. 8A is a graph of an Lv-V curve of a first pixel 82 (e.g., line 150) and an Lv-V curve of a second pixel 82 (e.g., line 152). The Lv-V curve of the line 150 and the Lv-V curve of the line 152 have been shifted a fixed amount to attempt to compensate for pixel property non-uniformities. The shifting may be performed on a per-programed voltage basis—meaning that, each time a programming voltage is used to drive the first pixel 82, the programming voltage is changed by a same, fixed amount each time. This same, fixed amount is represented by fixed correction 154 and is applied to the desired voltage level 156 to determine the programming voltage used to drive the first pixel 82 to emit light. For example, a controller 84 may determine to program the first pixel 82 with the voltage level 156 and before driving the first pixel 82 with the voltage level 156, the controller 84 may perform a fixed correction (e.g., apply fixed correction 154) to compensate for non-uniformities between pixels 82 to generate a programming voltage at a voltage level 158. When driven at the voltage level 158, the first pixel 82 emits light at the same brightness level as the expected response represented by line 104, that is brightness level 160. While the fixed correction 154 may be suitable for some target brightness levels (e.g., brightness level 160), the fixed correction 154 may not be suitable for other target brightness levels (e.g., brightness level 166). In this way, a fixed correction may work for some target brightness levels but not for others. For example, when the controller 84 applies the same fixed correction (e.g., fixed correction 154) to a voltage level 162, the first pixel 82 emits according to a voltage level 164 that causes a brightness level of 166 instead of a target brightness level of 168. This suitability is shown through an elimination of the net disparity 120 and a reduction of net disparity 118 but not an elimination of the net disparity 118.

Figure 8B:
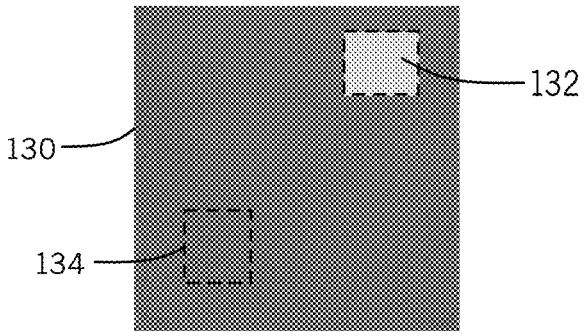
FIG. 8B is an illustration of non-uniform light emitted between pixels of the display of FIG. 5 corresponding to results of a fixed correction, in accordance with an embodiment.

FIG. 8B is an illustration depicting how the above-described fixed correction techniques may reduce visual artifacts on the display 18. The illustration represents a response of the display 18 to a target brightness level corresponding to 5 nits. Comparing FIG. 8B to FIG. 7B, the display panel 130 shows the portion 132 as different from the portion 134 in FIG. 7B but in FIG. 8B, the portion 132 and the portion 134 appear more uniform. The differences between the portion 132 and the portion 134 may be caused by material differences in transistors, for example, the transistor 93 or other transistors in a pixel 82, but are improved in response to the controller 84 applying the fixed correction to the programming voltages applied to the pixels 82. However, as described with FIG. 8A, these corrections may cause less improvement at lower brightness levels (e.g., less than 0.3 nit).

Figure 9A:
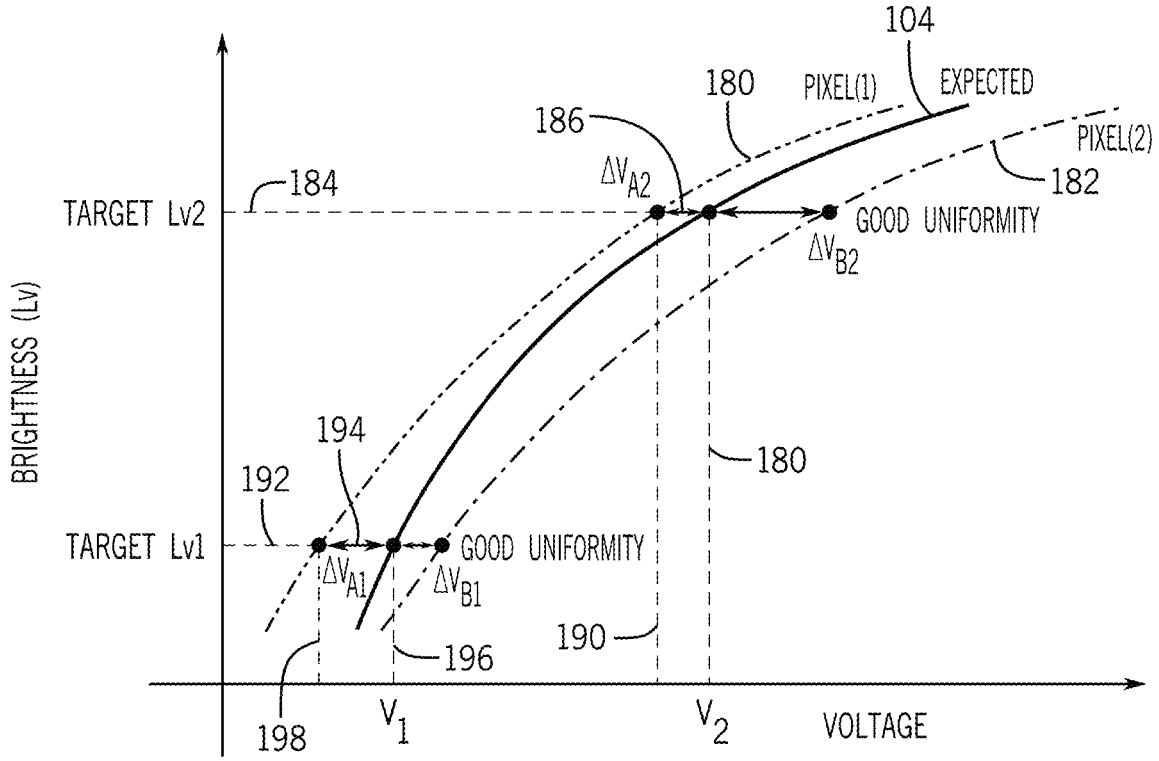
FIG. 9A is a graph of brightness-to-voltage (Lv-V) curves corresponding to two pixels of the display of FIG. 5 including a depiction of correction based on a per-pixel function, in accordance with an embodiment.

To improve the fixed correction techniques at lower brightness levels (e.g., to eliminate the net disparity 118 in addition to maintaining the eliminated net disparity 120), the controller 84 may use dynamic correction techniques, including applying a per-pixel function to determine a suitable correction a programming voltage. FIG. 9A is a graph of an Lv-V curve of a first pixel 82 (e.g., line 180) and an Lv-V curve of a second pixel 82 (e.g., line 182). The Lv-V curve of the line 180 and the Lv-V curve of the line 182 have essentially shifted an amount based on applying the per-pixel function to each respective pixel 82 (e.g., the first pixel 82 and the second pixel 82) to compensate for non-uniform pixel properties—meaning that, each time a programming voltage is used to drive the first pixel 82, the programming voltage may be changed by an amount specific to that particular pixel 82 to cause light emission from that pixel 82 at the target brightness level.

The effect of basing the compensation at least in part on the per-pixel function is depicted through the difference in compensations used on the Lv-V curves. For example, to cause the first pixel 82 to emit light at a brightness level 184, the programming voltage is changed an amount 186 from a first voltage level 188 to a second voltage level 190, while to cause the first pixel 82 to emit light at a brightness level 192, the programming voltage is changed by an amount 194 from a voltage level 196 to a voltage level 198, where the amount 194 may be different from the amount 186 (based on the per-pixel function for the first pixel 82). In this way, the amount 194 and the amount 186 may be different from the corresponding compensation amounts used for the second pixel 82. For example, a compensation amount 194 differs from the corresponding compensation amount 186 used to correct pixel non-uniformities of the first pixel 82.

Figure 9B:
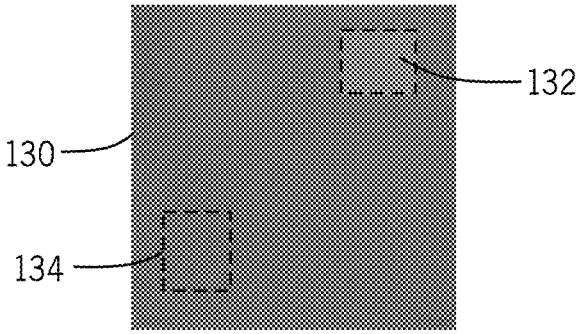
FIG. 9B is an illustration of non-uniform light emitted between pixels of the display of FIG. 5 corresponding to results of the correction based on a per-pixel function, in accordance with an embodiment.

FIG. 9B is an illustration depicting how the above-described dynamic correction techniques based on a per-pixel function may reduce visual artifacts on the display 18. The illustration represents a response of the display 18 to a target brightness level corresponding to 0.3 nit. Comparing FIG. 9B to FIG. 8B, the portion 132 and the portion 134 are perceived as uniform by a user of the display 18 despite being driven to emit light at a low brightness level (e.g., 0.3 nit). Previously illustrated differences between the portion 132 and the portion 134 (e.g., as illustrated in FIG. 7A) are now improved at low voltages in addition to high voltages. These differences are improved because the controller 84 compensates the programming voltages applied to the pixels 82 based on a per-pixel function applied to extracted parameters for each respective pixel 82 (or for regions of pixels 82).

Thus, as shown in FIG. 9A and FIG. 9B, a compensation based on a per-pixel function may be applied to more accurately account for varying Lv-V characteristics among pixels 82. To perform this compensation, the controller 84 or the processing core complex 12 may use an approximation of the Lv-V curve of the pixel 82 as the per-pixel function. Although described in terms of the approximated Lv-V curve herein, it should be understood that a per-pixel function may be any suitable relationship or function (e.g., a linear regression, a power law model, an exponential model) that correlates a data signal input to a brightness of light emitted by the pixel 82. When properly compensated, two pixels 82 intended to be driven at the same gray level may receive different programming voltages that result in the brightness level of light emitted. For example, a first pixel 82 may generate a current of a first value in response to a first voltage applied and a second pixel 82 may emit light at the same first brightness level in response to a second voltage applied, where the difference between the first and the second voltages account for the non-uniform properties between the pixels 82.

Figure 10:
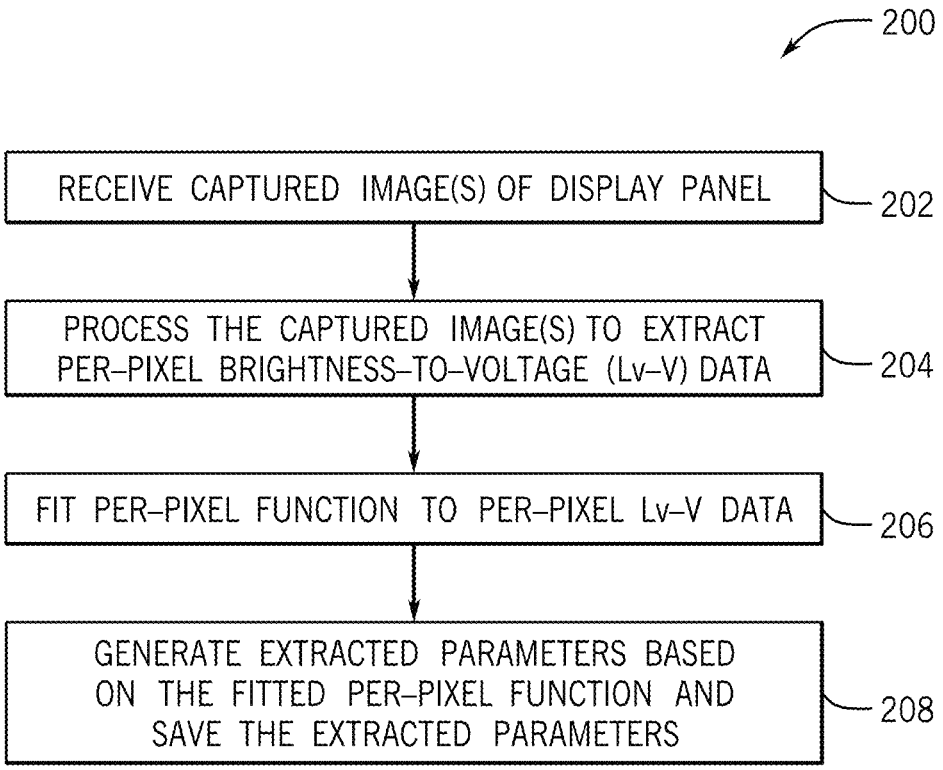
FIG. 10 is a flowchart of a process for deriving a per-pixel function, in accordance with an embodiment.

To help explain the per-pixel function, FIG. 10 is a flowchart of an example process 200 for extracting parameters to be later used in dynamic correction techniques. The process 200 of FIG. 10 includes receiving captured image(s) of a display 18 panel (block 202), processing the image(s) to extract per-pixel Lv-V data (block 204), fitting a per-pixel function to the per-pixel Lv-V data (block 206), and generating extracted parameters and saving the extracted parameters (block 208). It should be understood that, although the process 200 is described herein as being performed by the controller 84, any suitable processing circuitry, such as the processing core complex 12 or additional processing circuitry internal or external to the display 18, may perform all or some of the process 200. It should also be understood that the process 200 may be performed in any suitable order, including an order other than the described order below, and may include additional steps or exclude any of the described steps below.

At block 202, the controller 84 receives one or more captured images of a display 18 panel. These images may be captured during a calibration and/or testing period, where test image data is used to determine what per-pixel compensations to apply to each pixel 82 of the display 18 being tested. Programming voltages based on the test image data may be used to drive the pixels 82 to display a test image corresponding to the test image data. After the pixels 82 begin to display the test image, an external image capture device, or other suitable method of capturing images, may be used to capture one or more images of the display 18 panel. The one or more images of the display 18 panel may capture an indication of how bright the different portions of the display 18 panel are or communicate relative brightness levels of light emitted by pixels 82 of the display 18 panel in response to the test image data.

After receiving the one or more images, at block 204, the controller 84 may process the one or more images to extract per-pixel Lv-V data. As described above, the received images indicate relative light intensity or brightness between pixels 82 and/or between regions of the display 18 panel. The controller 84 may process the received images to determine the response of the pixel 82 to the test data. In this way, the controller 84 processes the received images to determine (e.g., measure, calculate) the brightness of the light emitted from the respective pixels 82 in response to the test data. The per-pixel Lv-V data determined by the controller 84 includes the known programming voltages (e.g., based on the test image data) and the determined brightness of light emitted.

At block 206, the controller 84 fits a per-pixel function to the per-pixel Lv-V data. The controller 84 may perform this curve-fitting in any suitable matter using any suitable function. A suitable function indicates a relationship between a programming voltage used to drive each pixel 82 and the light emitted from the pixel 82 in response to the programming voltage. The per-pixel function may be, for example, a linear regression, a power law model (e.g., current or brightness equals power multiplied by a voltage difference exponentially raised by an exponent constant representative of the slope between voltages), an exponential model, or the like. The relationship defined by the per-pixel function may be specific to a pixel 82, to a display 18, to regions of the display 18, or the like. In this way, one per-pixel function may be used for determining extracted parameters to define an Lv-V curve for a first pixel 82 while a different per-pixel function may be used for determining extracted parameters to define an Lv-V curve for a second pixel 82.

After fitting the per-pixel function to the per-pixel Lv-V data, at block 208, the controller 84 generates extracted parameters from the per-pixel function and saves the extracted parameters. In this way, the per-pixel function may represent a curve that is fitted to several data points gathered as the per-pixel Lv-V data but may be defined through a few key variables that represent the extracted parameters. Examples of the extracted parameters may include an amplitude, a rate of growth (e.g., expansion), slopes, constants included in a per-pixel function, or the like, where an extracted parameter is any suitable variable used to defined a fitted curve. The extracted parameters are extracted and saved for each pixel 82. These values may be stored in one or more look-up tables to be referenced by the controller 84 to determine the response of a respective pixel to a particular programming voltage. Fitting the per-pixel function to a dataset including the known programming voltages and/or the determined brightness of light emitted enables the per-pixel function to predict an overall input/output relationship for the pixel 82 based on extracted parameters associated with the fitted per-pixel function without having to store each individual data point of the input/output relationship.

Figure 11:
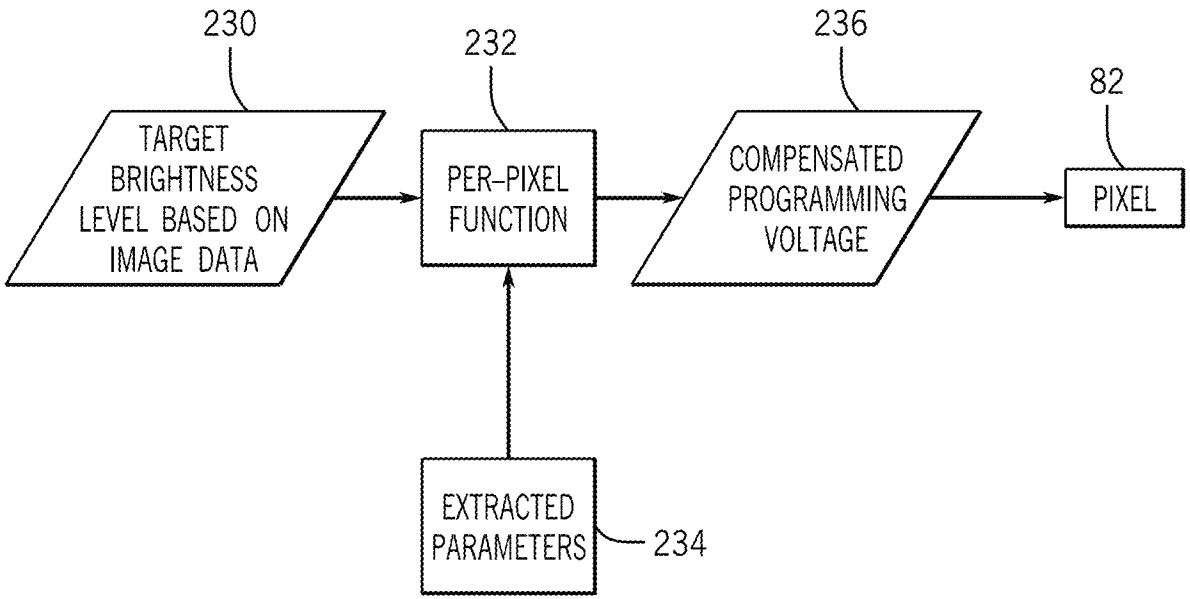
FIG. 11 is a block diagram representing applying a per-pixel function to obtain a compensated data signal used to drive the pixel of FIG. 6 to compensate for pixel non-uniformity, in accordance with an embodiment.

To better explain how the controller 84 may compensate for Lv-V non-uniformity among pixels 82, FIG. 11 is a block diagram illustrating the application of a dynamic correction techniques based on a per-pixel function and to a target brightness level 230. A variety of suitable components of the electronic device 10 may be used to perform the adjustments, including but not limited to, hardware and/or software internal and/or external to the display 18 (e.g., the controller 84 or the processing core complex 12).

In general, the controller 84 may apply the target brightness level 230 to a per-pixel function 232 that receives the target brightness level 230 and one or more extracted parameters 234 (e.g., variables based on the pixel 82). As described above, the per-pixel function 232 may be any suitable function that generally describes the Lv-V characteristics of each respective pixel 82. The extracted parameters 234 may be values stored in memory (e.g., in one or several look-up tables). When used in the function, the extracted parameters 234 permit the per-pixel function 232 to produce a first form of compensation for pixel values by, for example, translating the target brightness level to a corresponding programming voltage. This is shown in FIG. 11 as a compensated programming voltage 236, which may represent the programming voltage for the pixel 82 that is intended to achieve a target brightness level of light emitted from the LED 92 of the pixel 82.

As mentioned above, this first per-pixel function 232 may not always, on its own, provide a complete compensation. Indeed, the per-pixel function 232 may produce an approximation of the Lv-V curve of the pixel 82 based on the extracted parameters 234. Thus, rather than define the Lv-V curve of the pixel 82 using numerous measured data points, the Lv-V curve of the pixel 82 may be approximated using some limited number of variables (e.g., extracted parameters 234) that may generally define the Lv-V curve. The extracted parameters 234 may be determined based on measurements of the pixels 82 during manufacturing or based on measurements that are sensed using any suitable sensing circuitry in the display 18 to identify the Lv-V characteristics of each pixel 82.

Since the per-pixel function 232 provides an approximation of an actual Lv-V curve of a pixel 82, the resulting compensated programming voltage 236 (based on the target brightness level) may be further compensated in some examples (but not depicted). The compensated programming voltage 236 is used to program the pixels 82. Any additional compensations may be applied to the compensated programming voltage before being applied to the pixel 82.

Figure 12:
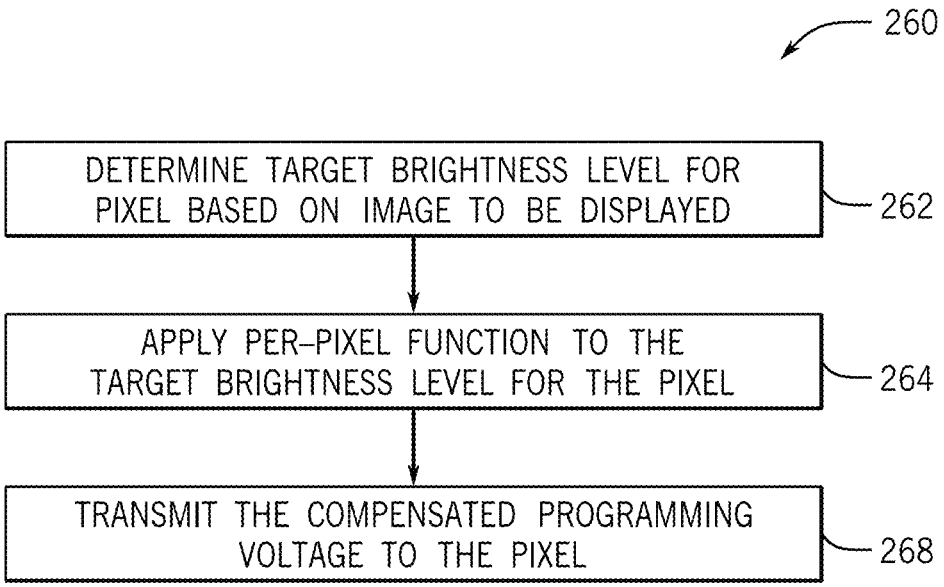
FIG. 12 is a flowchart of a process for applying the per-pixel function of FIG. 11, in accordance with an embodiment.

FIG. 12 is a flowchart of a process 260 for performing the dynamic correction techniques associated with the per-pixel function 232 of FIG. 11 that the controller 84 may follow in operating to correct for non-uniformities of the display 18 panel. The process 260 of FIG. 12 includes determining a target brightness level for a pixel to emit light at based on image to be displayed (block 262), applying a per-pixel function to determine a driving signal for the pixel (block 264), and transmitting the driving signal to the pixel (block 268). It should be understood that, although the process 260 is described herein as being performed by the controller 84, any suitable processing circuitry, such as the processing core complex 12 or additional processing circuitry internal or external to the display 18, may perform all or some of the process 260. It should also be understood that the process 260 may be performed in any suitable order, including an order other than the described order below, and may include additional steps or exclude any of the described steps below.

At block 262, the controller 84 determines a target brightness level 230 for a pixel 82 to emit light at based on image data. The target brightness level 230 corresponds to a gray level associated with a portion of the image data assigned to the pixel 82. The controller 84 uses the target brightness level 230 to determine a compensated programming voltage 236 to use to drive the pixel 82. A proportion associating the gray level indicated by the image data to a target brightness level, or any suitable function, may be used in determining the target brightness level 230.

At block 264, the controller 84 applies the per-pixel function 232 to the target brightness level 230 for the pixel 82 to determine a compensated programming voltage 236. The controller 84 determines a compensated programming voltage 236 for the pixel 82 based on the target brightness level 230 and based on the extracted parameters 234. The extracted parameters 234 are used to predict the particular response of the pixel 82 to the various programming voltages that may be applied (e.g., the per-pixel function 232 for that pixel 82). Thus, based the per-pixel function, the controller 84 determines the programming voltage 236 to apply to cause the pixel 82 to emit at the target brightness level 230, or a compensation to make to a programming voltage to be transmitted to the pixel 82 (e.g., such as in cases where each pixel 82 to emit at the target brightness level 230 receives the same programming voltage that is later changed before being used to drive a pixel 82 based on the per-pixel function 232 for the pixel 82). It should be noted that although described as a programming voltage, the compensated programming voltage 236 may be any suitable data signal used to change a brightness of light emitted from the pixel 82 in response to image data. For example, the controller 84 may determine and/or generate a control signal used to change a data signal, such as a programming voltage, to generate a compensated data signal, such as the compensated programming voltage 236.

Using the compensated programming voltage 236, at block 268, the controller 84 may transmit the compensated programming voltage 236 to the pixel 82 by operating a driver 86 of the display 18 to output the compensated programming voltage 236 level to the pixel 82. The compensated programming voltage 236 causes the pixel 82 to emit light at the target brightness level 230. Thus, through the controller 84 transmitting the compensated programming voltage 236 to the pixel, visual artifacts of the display 18 are reduced via correction and compensation for non-uniform properties between pixels 82.

Figure 13:
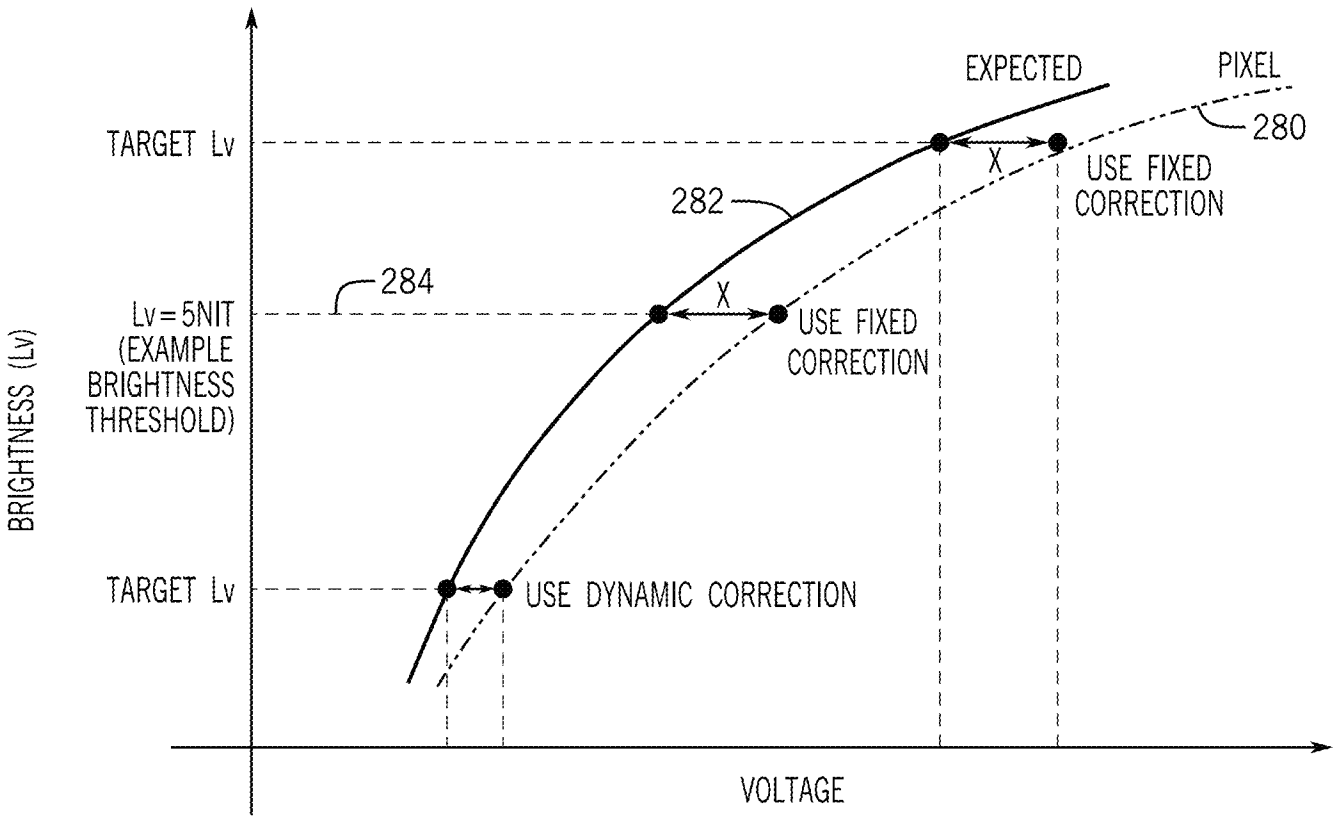
FIG. 13 is a graph of brightness-to-voltage (Lv-V) curves corresponding to an example correction technique that uses a dynamic correction based on a per-pixel function for low brightness values and a fixed correction for higher brightness values to obtain a compensated data signal used to drive the pixel of FIG. 6 to compensate for pixel non-uniformity, in accordance with an embodiment.

In some examples, a technique using a combination of a fixed correction and a dynamic correction may be applied by the controller 84 to compensate for non-uniform properties of pixels 82. FIG. 13 is a graph of an Lv-V curve of a first pixel 82 (e.g., line 280) and an Lv-V curve associated with an expected response of a pixel 82 to various programming voltages (e.g., line 282). The controller 84 using a combination of techniques to determine a programming voltage may apply a certain technique for target brightness levels 230 below a threshold and may apply a different technique for target brightness levels 230 above or at the threshold. For example, as is depicted, the controller 84 applies the fixed correction (e.g., value of x) for target brightness levels 230 at or above the threshold brightness level of 5 nit (e.g., threshold level 284) but uses dynamic correction techniques for target brightness levels 230 (e.g., to correct by any suitable value) below the threshold brightness level of 5 nit. It should be understood that the threshold brightness level may equal any suitable brightness level and that any number of thresholds may be used to control the compensation technique used for various target brightness levels. Using a combination of techniques may lessen processing resources while maximizing benefits from using the per-pixel function 232 for target brightness levels 230 below the threshold brightness level and minimizing processing resources dedicated to target brightness levels 230 above or at the threshold brightness level where a fixed correction may be a suitable form of correction to apply.

In addition to determining the per-pixel function 232 and extracted parameters 234 (e.g., via the process 200), the controller 84 receives one or more images at the block 202. The number of images received by the controller 84 may correspond to a number of missing variables of the per-pixel function, such that the images may facilitate a creation of a system of equations to determine one or more unknown variables. For example, three images may be captured and transmitted to the controller to be used to determine three unknown variables. These captured images may represent different outputs to different test data. In this way, a first test programming voltage may be used to generate a first captured image and a second test programming voltage may be used to generate a second captured image, where both the first captured image and the second captured image may be used to determine the extracted parameters. In some examples, the one or more unknown variables correspond to the extracted parameters 234.

Figure 14:
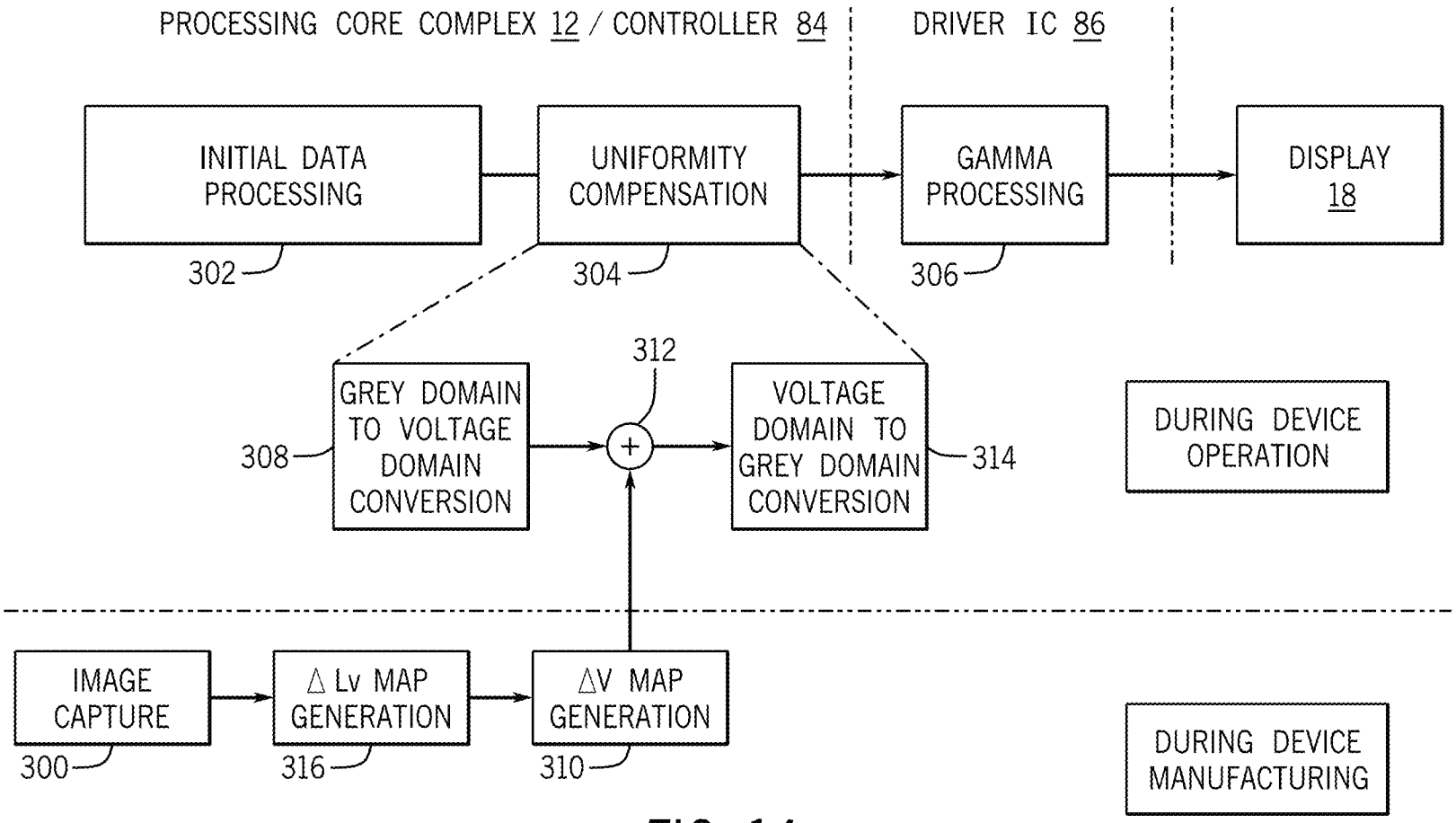
FIG. 14 is a block diagram representing compensation systems that apply a per-pixel function to obtain a compensated data signal used to drive the pixel of FIG. 6 to compensate for pixel non-uniformity, in accordance with an embodiment.

Keeping the foregoing in mind, a map may result from the above-described image captures. FIG. 14 is a block diagram illustrating a compensation system that applies a per-pixel function derived from an image (e.g., image capture operations 300) when compensating for non-uniform properties between pixels 82. The compensation system may include several operations performed throughout the electronic device 10. For example, the compensation system of the electronic device 10 may perform initial data processing operations 302 (e.g., white point correction operations, burn-in compensation operations, dithering operations, or the like) and uniformity compensation operations 304 via the processing core complex 12, the controller 84, and/or other suitable processor, such as a display pipe or display pipeline of the processing core complex 12, may perform gamma processing operations 306 via one or more of the drivers 86, and may drive pixels 82 of the display 18 to present images based on outputs from the gamma processing operations 306. The application of the per-pixel function may occur during the uniformity compensation operations 304, as previously described with respect to FIGS. 1-13.

To do this, one or more input gray domain programming voltages are converted into voltage domain programming voltages via gray domain to voltage domain conversion operations 308. While at least one programming voltage is in the voltage domain, the processing core complex 12 and/or the controller 84 may reference a voltage map generated during manufacturing of the electronic device 10 (e.g., ΔV map generation operations 310) to determine the per-pixel function 232 applicable to the programming voltage. The per-pixel function 232 is applied to the programming voltage in the voltage domain via summation block 312, and the output is converted back into the gray domain via a voltage domain to gray domain conversion operation 314 for use in additional preparatory operations before being used as the compensated programming voltage 236. For ease of discussion herein, it should be understood that the processing core complex 12 and/or the controller 84 may perform the described operations even if the controller 84 is referred to as performing the operation.

The per-pixel function 232 may be derived from an image captured of the display 18 while operated at a particular input brightness value. In this way, the image captured during the image capture operations 300 may be used to generate one or more maps (e.g., during electronic device 10 manufacturing and/or calibration). For example, image data of the image captured via the image capture operations 300 may be used to generate a change in brightness map (e.g., ΔLv map via ΔLv map generation operations 316) and to generate, from the ΔLv map, a change in voltage map (ΔV map). In some cases, the per-pixel functions 232 based on the ΔV map may be relatively less accurate as the input brightness value of the display 18 at a time of compensation (e.g., during operation rather than manufacturing and/or calibration) deviates from the input brightness value of the display 18 at a time of the image capture operations 300 (e.g., during manufacturing and/or calibration).

Figure 15:
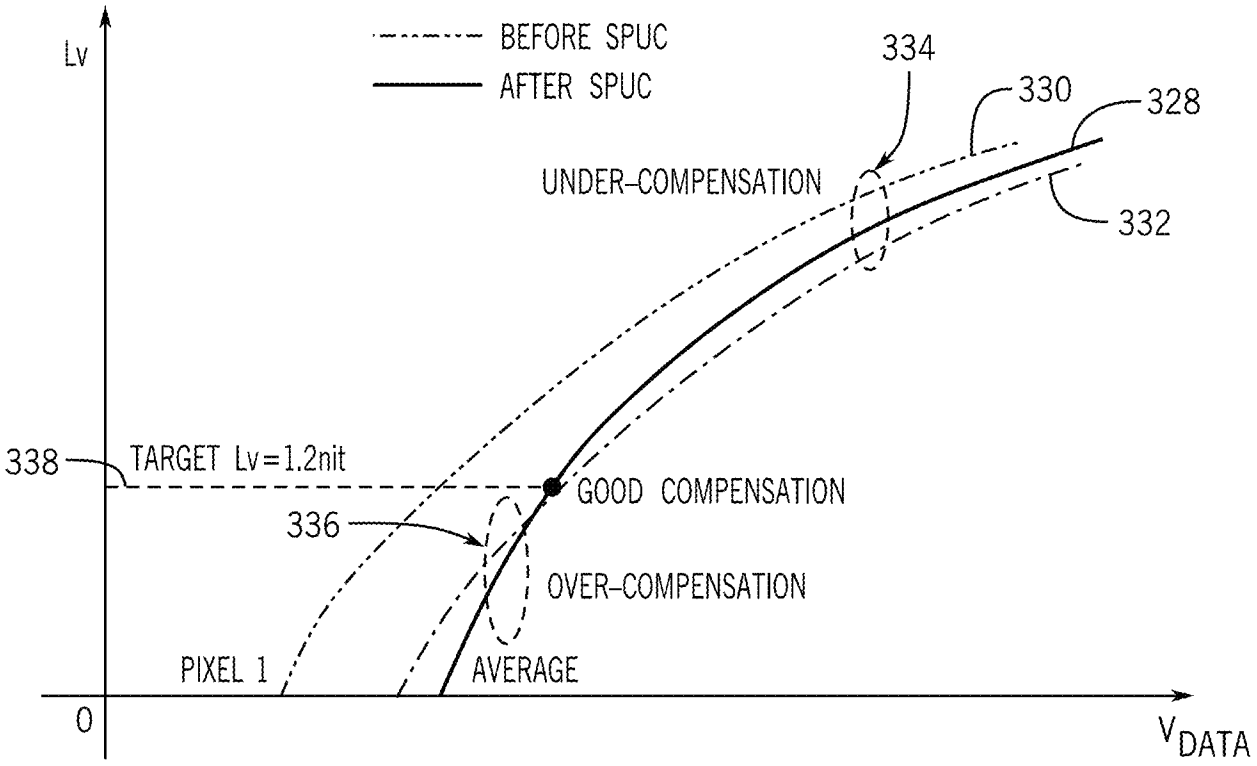
FIG. 15 is a graph of brightness-to-voltage (Lv-V) curves corresponding to two pixels of the display of FIG. 5 including a depiction of an example of an inconsistent correction based on a per-pixel function due at least in part to screen brightness affecting the per-pixel functions, in accordance with an embodiment.

An example of this deviation is shown in FIG. 15. FIG. 15 is a graph of brightness-to-voltage (Lv-V) curves corresponding to a pixel 82 of the display 18. When compensating programming voltages according to pre-determined per-pixel functions 232, under-compensation or over-compensation may result when not applying a particular per-pixel function 232 to a programming voltage with consideration for brightness values of the display 18. In the graph of FIG. 15, line 328 represents an average Lv-V curve of pixels 82 of the display 18 while line 330 represents the particular per-pixel behavior for a first pixel 82 (e.g., pixel 1). When compensating programming voltages to cause the first pixel 82 to emit light according to the average Lv-V curve, the extracted parameters 234 referenced may compensate the programming voltage data in such a way as to cause the first pixel 82 to emit according to an Lv-V curve represented by line 332. As shown via arrow 334 and arrow 336, when consideration is not paid to a brightness value of the display 18 at a time of compensation, over-compensation or under-compensation may result. For example, if the Lv-V curve was generated based on an image captured which the display 18 was at an input brightness value 338 (e.g., 1.2 nit), accurate compensation may be performed when the pixel 82 is to present at the input brightness value 338. However, any deviation from the input brightness value 338 at a time of image capture may lessen an accuracy of the compensation, and may manifest as an under-compensation (e.g., arrow 334) or over-compensation (e.g., arrow 336).

Generating several maps at different brightness levels during image capture operations 300 and map generation operations 310, 316, and later selecting a specific map based on real-time operating conditions may improve compensation operations. For example, a map may be selected in response to an input brightness value and be used to derive a per-pixel function 232 associated with a particular pixel 82 and associated with the real-time operating condition.

Figure 16:
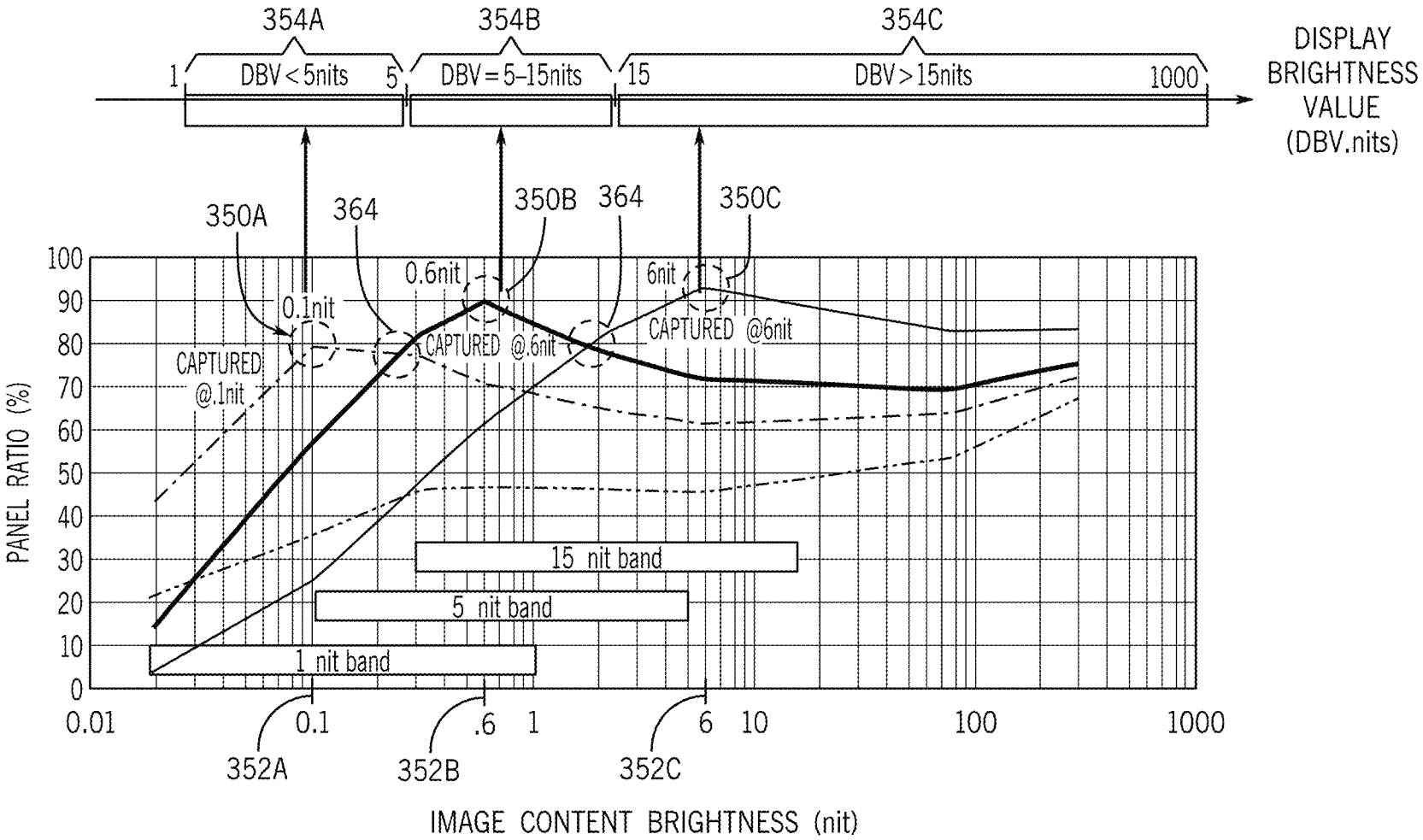
FIG. 16 is a graph depicting how applying per-pixel functions based on an input brightness value of a display may improve adjustment operations, in accordance with an embodiment.

To help explain further, FIG. 16 is a graph that compares image content brightness and panel ratio. This graph highlights how compensation performance peaks at a luminance of capture 352 (352A, 352B, 352C), as represented via arrows 350 (350A, 350B, 350C), and degrades in response to deviation from the luminance of capture 352 (e.g., at lower and/or higher brightness values). For example, maps resulting from the luminance of capture 352A (e.g., input brightness value equal to about 0.1 nit) may be used to cause a relatively good compensation when the display 18 is to emit according to an input brightness value around the luminance of capture 325A (e.g., 0.1 nit). However, when the same map is applied to a compensation associated with an input brightness value deviated from the luminance of capture (e.g., 10-100 nits), the compensation quality may decrease. Since maps resulting from image captures at different luminance of capture values may be relatively optimal at different input brightness values, capturing two or more image captures and generating two or more maps may improve compensation operations of the display 18 when operating ranges are used to determine how to pair input brightness values with resulting maps. In this way, the map selected for use in a particular compensation operation may correspond to an operating range that a particular input brightness value is within, and thus the map and compensation operation may be better suited overall for the particular input brightness value.

In this way, operational ranges 354 (354A, 354B, 354C) may be defined for a particular display 18. Each of the operational ranges 354 may correspond to one or more original image captures and a map. For example, the operational range 354A corresponds to a map that results from images captured at a luminance of capture equal to 0.1 nit while the operational range 354B corresponds to a map that results from images captured at a luminance of capture equal to 0.6 nit. Based on the input brightness value, a different operational range of the operational ranges 354 is selected as a way to select the map for uniformity compensation operations 304. In this way, if the input brightness value is less than 5 nits, the selected operational range is operational range 354A, and thus the map corresponding to operational range 354A may be applied as part of the compensation, while if the input brightness value exceeds 15 nits, the selected operational range is operational range 354C which leads to applying the map corresponding to the operational range 354C. Many different methods may be used to determine a suitable number and respective sizes of operational ranges 354. For example, as shown in FIG. 16, the operational ranges 354 may correspond to the image content brightness at which each respective map overlaps at (e.g., cross-over points 364) when plotting image content brightness relative to panel ratio.

Figure 17:
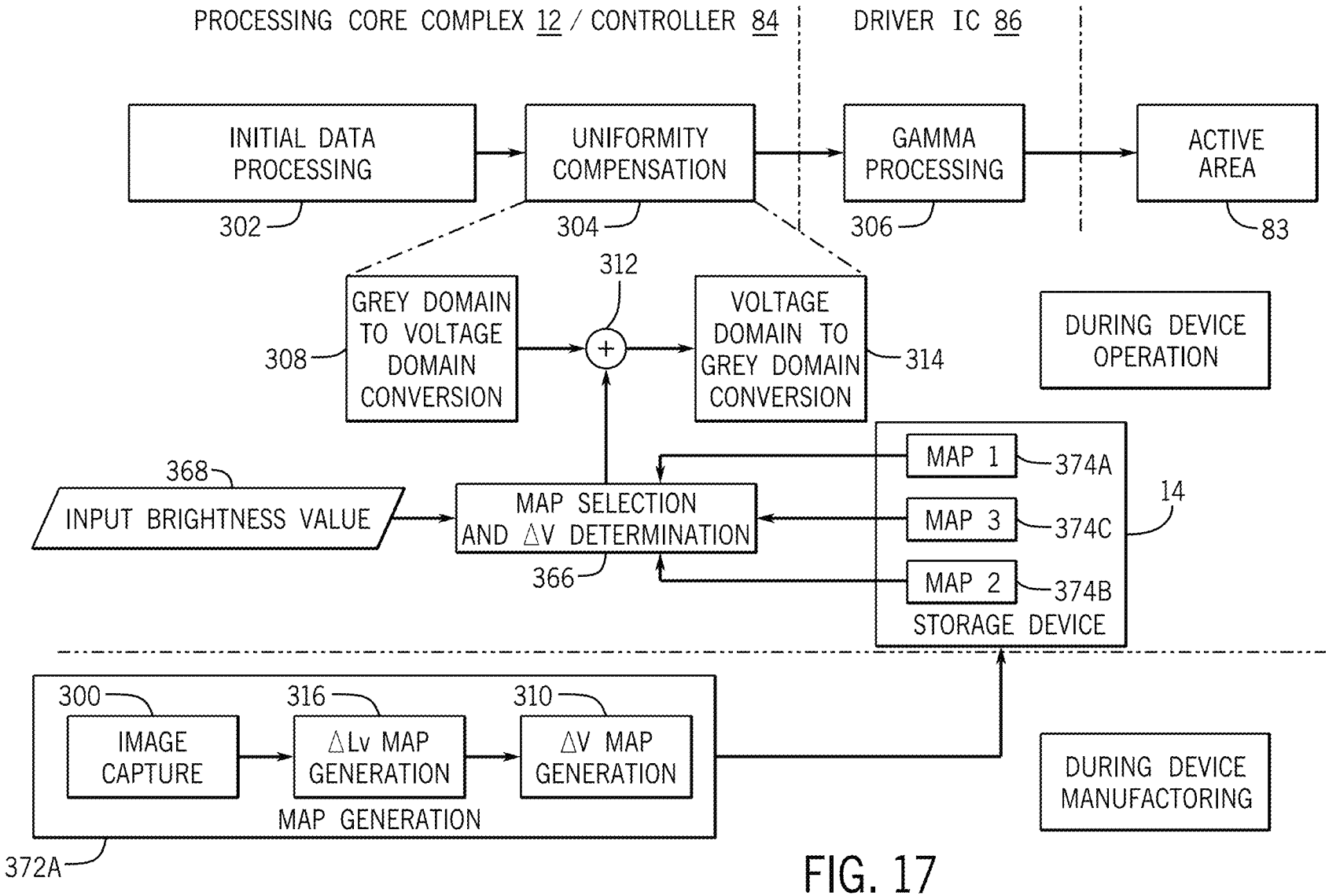
FIG. 17 is a block diagram representing application of a per-pixel function based on the brightness of the display to obtain a compensated data signal used to drive the pixel of FIG. 6 to compensate for pixel non-uniformity, in accordance with an embodiment.

This selection process is described via FIG. 17. FIG. 17 is a block diagram representing compensation systems that apply a per-pixel function 232 based on the brightness of the display to obtain a compensated programming voltage to compensate for pixel non-uniformity. FIG. 17 includes a map selection operation 366, where the controller 84 determines and selects a ΔV map 374 from multiple ΔV maps 374 (374A, 374B, 374C) based on an input brightness value 368. Similar operations between FIG. 14 and FIG. 17 are not additionally described, and thus descriptions from FIG. 14 are relied upon herein.

During manufacturing of the electronic device 10, when calibration operations are performed, multiple image capture operations 300 may be performed at different brightness levels (e.g., different luminance of capture levels). Any suitable number of brightness levels and image capture operations 300 may be performed. The image capture operations may be performed as part of map generation operations 372A used to generate one or more ΔV maps 374 in response to image captures performed at the different brightness levels. Each image capture operation 300, and resulting ΔV map 374, may correspond to one of the operational ranges 354 described in FIG. 16. In this way, after receiving the input brightness value 368, the controller 84 may select a ΔV map 374 and an operational range 354 that includes the input brightness value 368 via map selection operations 366.

Figure 18:
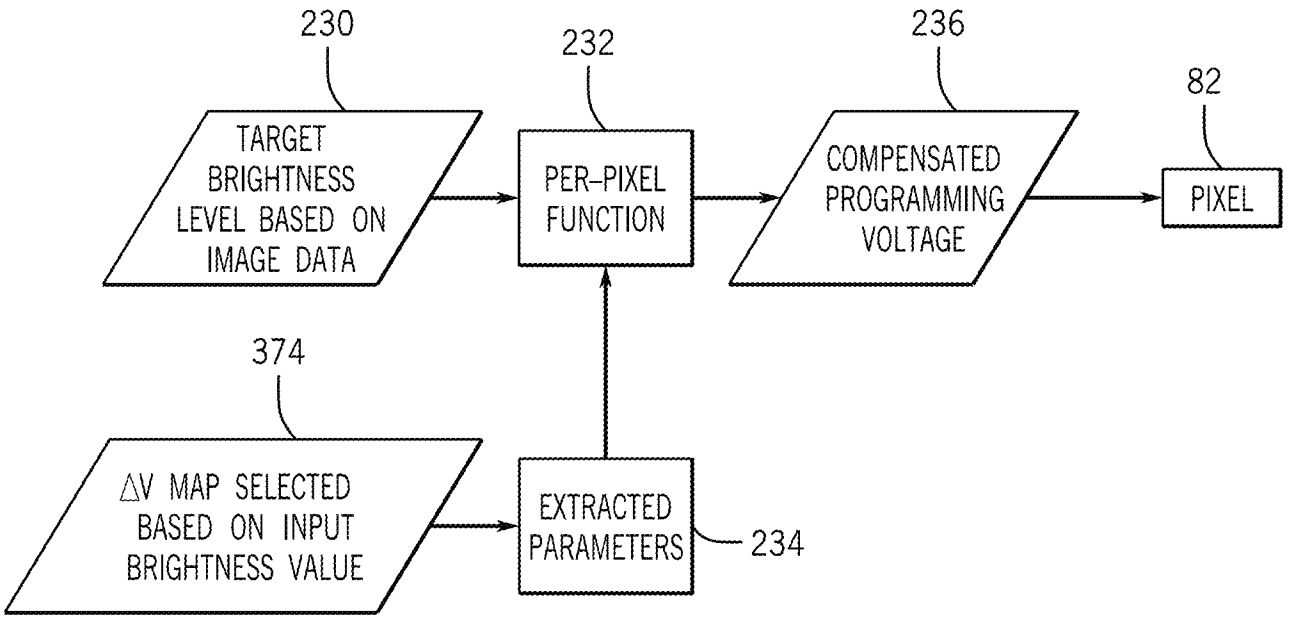
FIG. 18 is a block diagram representing applying a per-pixel function based on a brightness value to obtain a compensated data signal used to drive the pixel of FIG. 6 to compensate for pixel non-uniformity, in accordance with an embodiment.

This process is additionally depicted in FIG. 18. FIG. 18 is a block diagram representing applying a per-pixel function 232 based on an input brightness value 368 to obtain a compensated programming voltage 236 used to drive a pixel 82 to compensate for manifested non-uniformity. Here, many operations are repeated from FIG. 11 (and thus descriptions are relied upon herein), however the extracted parameters 234 are derived from a ΔV map 374 selected based on the input brightness value 368. This improves the compensation operations because the ΔV map 374 is selected in response to actual operating conditions, permitting the suitable data for the corresponding operational range 354 to be applied to the pixels 82.

The input brightness value 368 may be a global brightness value. For example, the input brightness value 368 may correspond or be the brightness level of the display 18, and thus may change in response to ambient lighting conditions of the electronic device 10. In some examples, the input brightness value 368 may be a value derived or generated based on a histogram of an image to be displayed, a histogram of an image that is currently displayed, and/or a histogram of an image previously displayed. Furthermore, in some examples, the input brightness value 368 may correspond to a regional brightness, such as a brightness of a subset of pixels 82 of the display 18 or a brightness of an image to be presented via a subset of pixels 82 of the display. The input brightness value 368 may also be determined on a per-pixel basis, such as associated with a brightness that the pixel 82 is to emit light.

Figure 19:
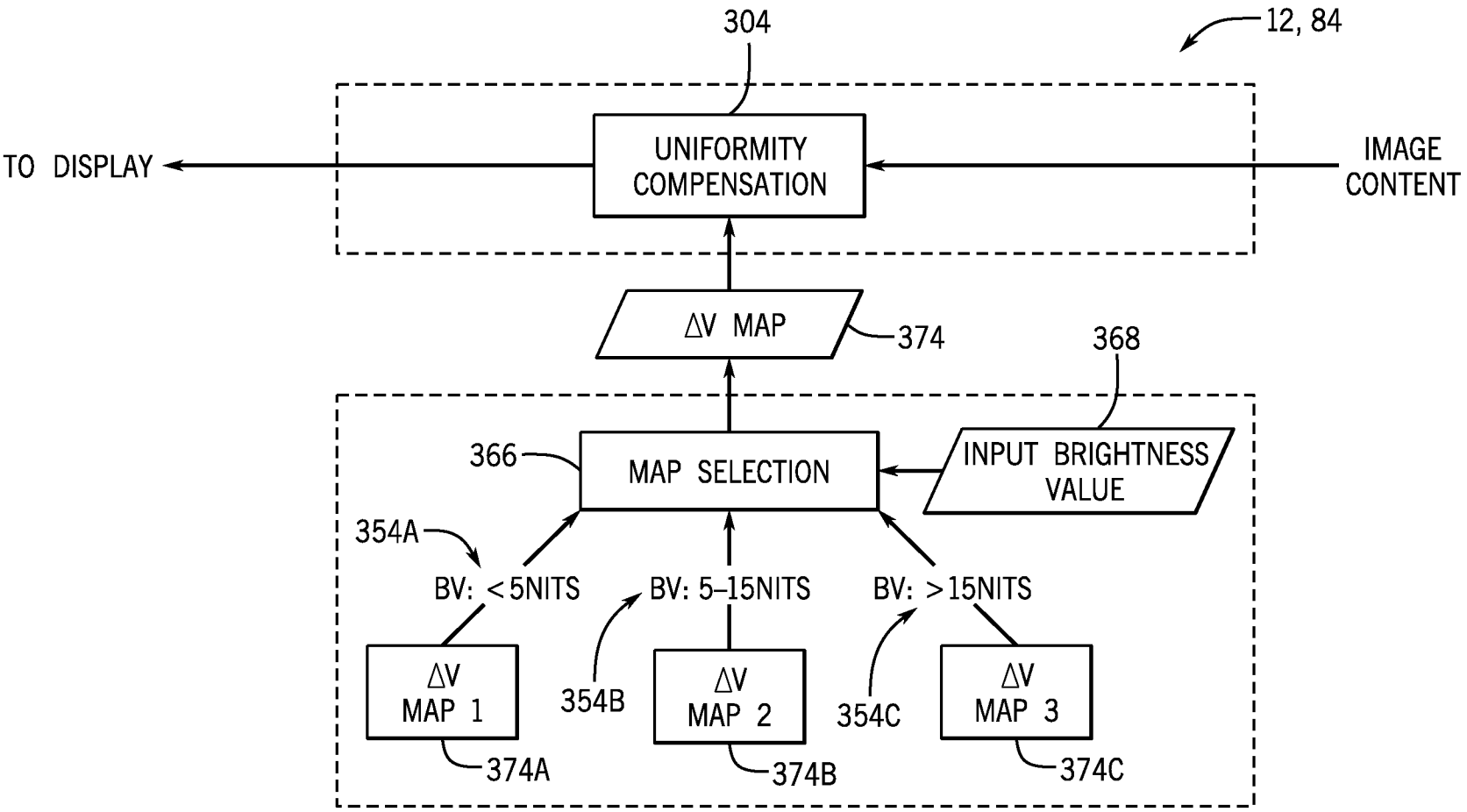
FIG. 19 is a block diagram of selecting a map to use to determine the per-pixel function of FIG. 18 based on an input brightness value, in accordance with an embodiment.

To help visualize further, FIG. 19 is a block diagram of selecting the ΔV map 374 to use to determine the per-pixel function 232 based on the input brightness value via map selection operations 366. It is noted that the map selection operations 366 and/or the uniformity compensation operations 304 may be performed via hardware or software, or both hardware and software. For example, the map selection operation 366 may be a software application that selects the ΔV map 374 based on the input brightness value 368 and outputs a signal to cause the controller 84 to add a suitable voltage with a programming voltage to generate a compensated programming voltage 236. As previously described, the controller 84 may retrieve two or more ΔV maps 374 (374A, 374B, 374C) from memory (e.g., storage device 14) and use the input brightness value 368 (and which of the operational ranges 354 corresponding to the input brightness value 368) to select the ΔV map 374 (e.g., 374A, 374B, or 374C) to use. This may enable programming voltages to be compensated for non-uniform properties of the display 18 that persist between different input brightness values 368. The compensated programming voltages 236 may be transmitted from the uniformity compensation operations 304 of the controller 84 to the display 18 for use in driving one or more pixels 82 of the display 18.

In some cases, the input brightness value 368 may be of a value that is between defined brightness values corresponding to the various ΔV maps 374. The map selection operation 366 may thus include performing an interpolation between two ΔV maps 374 (e.g., two of the ΔV maps 374 that correspond to the defined brightness values adjacent or close to the input brightness value 368). In this way, when the input brightness value 368 is between calibrated control points (e.g., brightness values corresponding to each of the ΔV maps 374), a new map may be dynamically generated that corresponds to the input brightness value 368. Linear interpolation may be used to generate a map that corresponds to the input brightness value 368 that falls between defined brightness values of ΔV maps 374.

Figure 20:
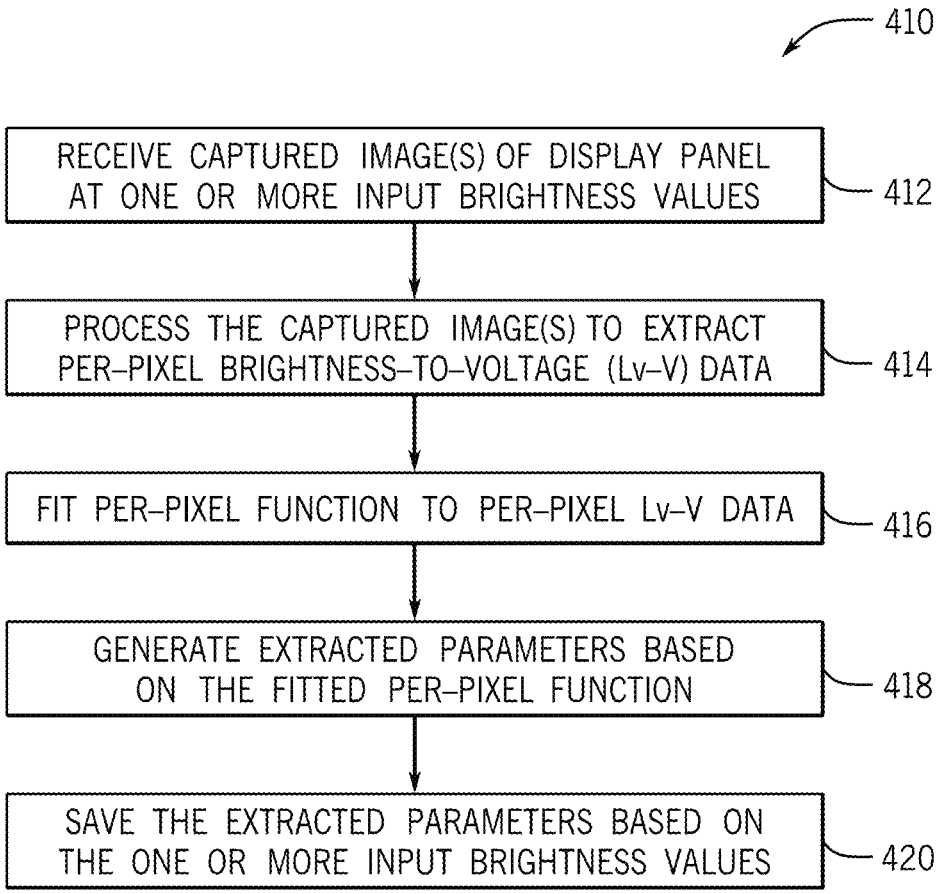
FIG. 20 is a flowchart of a process for generating the map of FIG. 19, in accordance with an embodiment.

FIG. 20 is a flowchart of an example process 410 for generating the ΔV maps 374 of FIG. 19 and for extracting parameters to be later used in dynamic correction techniques. The process 410 of FIG. 20 includes receiving capture image(s) of display panel at one or more input brightness values (block 412), processing the captured image(s) to extract per-pixel Lv-V data (block 414), fitting a per-pixel function to the per-pixel Lv-V data (block 416), and generating extracted parameters (block 418), and saving the extracted parameters (block 420). It should be understood that, although the process 410 is described herein as being performed by the controller 84, any suitable processing circuitry, such as the processing core complex 12 or additional processing circuitry internal or external to the display 18, may perform all or some of the process 410. It should also be understood that the process 410 may be performed in any suitable order, including an order other than the described order below, and may include additional steps or exclude any of the described steps below. It is also noted that in some cases, some or all of these operations may be performed during manufacturing or at a time of display 18 and/or calibration of the electronic device 10.

At block 412, the controller 84 may receive one or more captured images of a panel of a display 18. These images may be captured during a calibration and/or testing period, where test image data is used to determine what per-pixel compensations to apply to each pixel 82 of the display 18 being tested. Programming voltages based on the test image data may be used to drive the pixels 82 to display a test image corresponding to the test image data. Furthermore, test image data may also include varying of an input brightness value to determine how the pixels 82 behave in response to varying input brightness values. After the pixels 82 begin to display the test image, an external image capture device, or other suitable method of capturing images, may be used to capture one or more images of the panel of the display 18. The one or more images of the panel of the display 18 may capture an indication of how bright the different portions of the panel of the display 18 are or communicate relative brightness levels of light emitted by pixels 82 of the panel of the display 18 in response to the test image data. These captured images and associated input brightness values, such as a global brightness value of the display 18 at the time of capture, are recorded and stored into memory (e.g., storage devices 14). These captured images and associated input brightness values may be used to define the different operational ranges 354.

After receiving the one or more images, at block 414, the controller 84 may process the one or more images to extract per-pixel Lv-V data for each captured image corresponding to the differing operational ranges 354. As described above, the received images indicate relative light intensity or brightness between pixels 82 and/or between regions of the display 18 panel. The controller 84 may process the received images to determine the response of the pixel 82 to the test data that is the same but applied at different input brightness values. In this way, the controller 84 processes the received images to determine (e.g., measure, calculate) the brightness of the light emitted from the respective pixels 82 in response to the test data. The per-pixel Lv-V data determined by the controller 84 includes the known programming voltages (e.g., based on the test image data) and the determined brightness of light emitted.

At block 416, the controller 84 may fit a per-pixel function to the per-pixel Lv-V data on a per optional range basis. The controller 84 may perform this curve-fitting in any suitable matter using any suitable function. A suitable function indicates a relationship between a programming voltage used to drive each pixel 82 and the light emitted from the pixel 82 in response to the programming voltage. The per-pixel function may be, for example, a linear regression, a power law model (e.g., current or brightness equals power multiplied by a voltage difference exponentially raised by an exponent constant representative of the slope between voltages), an exponential model, or the like. The relationship defined by the per-pixel function may be specific to a pixel 82, to a display 18, to regions of the display 18, or the like, at a specific input brightness value. In this way, one per-pixel function may generate one set of extracted parameters 234 to define an Lv-V curve for a first pixel 82 at a first input brightness value 368 while a different per-pixel function may generate a second set of extracted parameters 234 to define an Lv-V curve for a second pixel 82 at a same or different input brightness value 368.

After fitting the per-pixel function 232 to the per-pixel Lv-V data, at block 418, the controller 84 may generate extracted parameters 234 from the per-pixel function and may save the extracted parameters 234 at block 420. In this way, the per-pixel function may represent a curve that is fitted to several data points gathered as the per-pixel Lv-V data but may be defined through a few key variables that represent the extracted parameters 234. Examples of the extracted parameters 234 may include an amplitude, a rate of growth (e.g., expansion), slopes, constants included in a per-pixel function, or the like, where an extracted parameter 234 is any suitable variable used to at least partially define a fitted curve. The extracted parameters 234 are extracted and saved for each pixel 82 and for each of the operational ranges 354. These values may be stored in one or more look-up tables to be referenced by the controller 84 to determine the response of a respective pixel 82 to a particular programming voltage at a particular input brightness value 368. Fitting the per-pixel function to a dataset including the known programming voltages and/or the determined brightness of light emitted enables the per-pixel function to predict an overall input/output relationship for the pixel 82 based on extracted parameters 234 associated with the fitted per-pixel function without having to store each individual data point of the input/output relationship.

Figure 21:
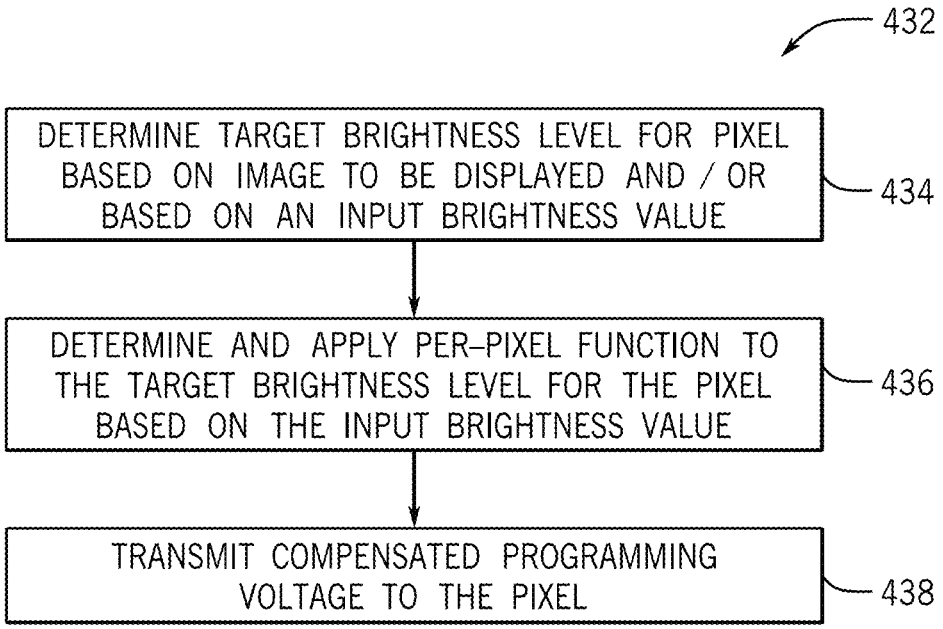
FIG. 21 is a flowchart of a process for applying a per-pixel function to compensate for pixel non-uniformities based on an input brightness value, in accordance with an embodiment.

FIG. 21 is a flowchart of a process 432 for performing the dynamic correction techniques associated with the per-pixel function 232 that the controller 84 may follow in operating to correct for non-uniformities of the display 18 panel. The process 432 includes determining a target brightness level for a pixel to emit light at based on image to be displayed and/or based on an input brightness value (block 434), applying a per-pixel function to determine a driving signal for the pixel based on the input brightness value (block 436), and transmitting the compensated programming voltage as a driving signal to the pixel (block 438). It should be understood that, although the process 432 is described herein as being performed by the controller 84, any suitable processing circuitry, such as the processing core complex 12 or additional processing circuitry internal or external to the display 18, may perform all or some of the process 432. It should also be understood that the process 432 may be performed in any suitable order, including an order other than the order described below, and may include additional steps or exclude any of the described steps below.

At block 434, the controller 84 may determine a target brightness level 230 for a pixel 82 to emit light at based on image data and/or based on the input brightness value 368. The target brightness level 230 corresponds to a gray level associated with a portion of the image data assigned to the pixel 82. The controller 84 uses the target brightness level 230 to determine a compensated programming voltage 236 to use to drive the pixel 82. A proportion associating the gray level indicated by the image data to a target brightness level, or any suitable function, may be used in determining the target brightness level 230.

At block 436, the controller 84 determines and applies the per-pixel function 232 based on the input brightness value 368 to the target brightness level 230 for the pixel 82 to determine a compensated programming voltage 236. The controller 84 determines a compensated programming voltage 236 for the pixel 82 based on the target brightness level 230, based on the extracted parameters 234, and based on the input brightness value 368 defining from which of the operational ranges 354 to source the extracted parameters 234. The extracted parameters 234 are used to predict the particular response of the pixel 82 to the various programming voltages that may be applied (e.g., the per-pixel function 232 for that pixel 82). Thus, based on the per-pixel function 232, the controller 84 determines the programming voltage 236 to apply to cause the pixel 82 to emit at the target brightness level 230, or a compensation to make to a programming voltage to be transmitted to the pixel 82 (e.g., such as in cases where each pixel 82 to emit at the target brightness level 230 receives the same programming voltage that is later changed before being used to drive a pixel 82 based on the per-pixel function 232 for the pixel 82). It should be noted that although described as a programming voltage, the compensated programming voltage 236 may be any suitable data signal used to change a brightness of light emitted from the pixel 82 in response to image data. For example, the controller 84 may determine and/or generate a control signal used to change a data signal, such as a programming voltage, to generate a compensated data signal, such as the compensated programming voltage 236.

Using the compensated programming voltage 236, at block 438, the controller 84 may transmit the compensated programming voltage 236 to the pixel 82 by operating a driver 86 of the display 18 to output the compensated programming voltage 236 level to the pixel 82. The compensated programming voltage 236 causes the pixel 82 to emit light at the target brightness level 230. Thus, through the controller 84 transmitting the compensated programming voltage 236 to the pixel, visual artifacts of the display 18 are reduced via correction and compensation for non-uniform properties between pixels 82.

Keeping the foregoing in mind, it is noted that the ΔV map 374 may be updated at various times during operation of the electronic device 10. For example, the ΔV map 374 may be updated during the processing of each image frame, or in response to a change in the input brightness value 368. Furthermore, in some embodiments, the ΔV map 374 is updated one or more frames after the input brightness value 368 was determined for a particular image frame. Other parameters than the input brightness value 368 may be used to select the ΔV map 374. For example, parameters like temperature and/or historic image data may be used in combination with or instead of the input brightness value 368. The input brightness value 368 may be determined independently of an image frame presented or to be presented via the display 18. For example, the input brightness value 368 may be an amount determined in response to a sensed amount of ambient light.

The foregoing descriptions relate to determining per-pixel (or per-regional) compensations based at least in part on per-pixel (or per-regional) functions generated using images captured of the display 18 during manufacturing. In some cases, an amount of data used to store per-pixel (or per-regional) functions may be reduced by instead storing anchor points of the per-pixel (or per-regional) function. An anchor point may define a compensation in terms of a voltage change, ΔV, to apply to a programming voltage (e.g., data voltage). In this way, the anchor point may represent a known compensation that is able to be used to derive other, unknown, or undefined adjustments to perform to input data voltages that do not correspond to an anchor point. For example, when a data voltage does not correspond to an anchor point, performing an interpolation on nearby anchor points may help to derive the ΔV compensation for the data voltage.

Figure 22:
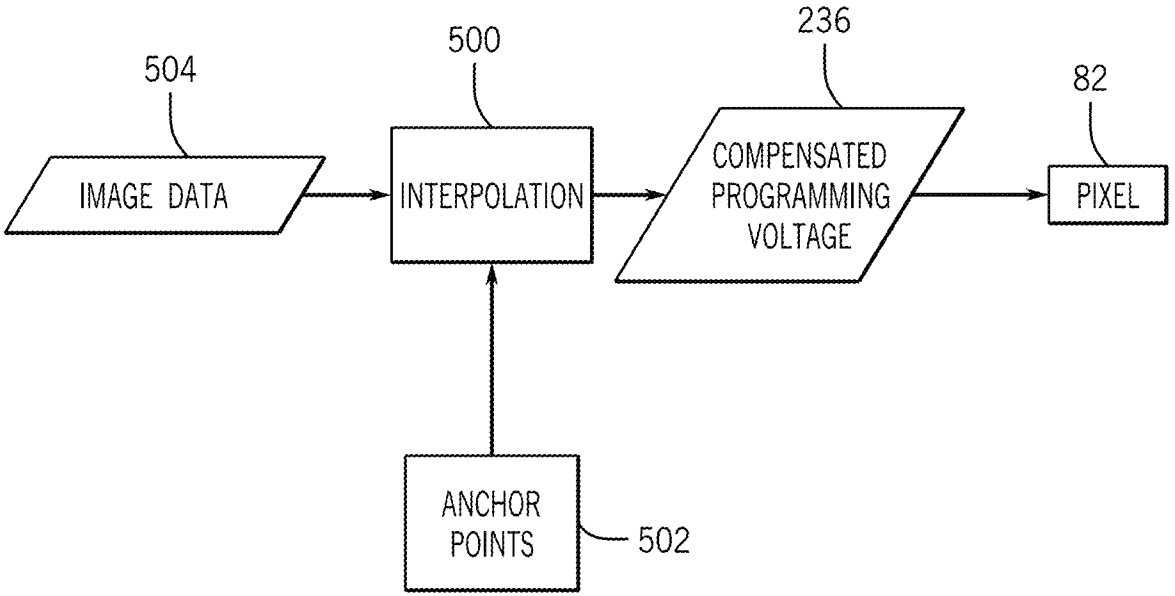
FIG. 22 is a block diagram representing using interpolation to obtain a compensated data signal used to drive the pixel of FIG. 6 to compensate for pixel non-uniformity, in accordance with an embodiment.

Keeping this in mind, FIG. 22 is a block diagram illustrating using interpolation 500 to obtain a compensated data signal (e.g., compensated programming voltage 236) for use in driving the pixel 82 to compensate for pixel non-uniformity. The interpolation 500 may be any suitable interpolation operation, such as a linear interpolation, a weighted interpolation, a polynomial interpolation, or the like. The interpolation 500 may determine the compensated programming voltage 236 based on anchor points 502 and input image data 504, where both the anchor points 502 and the image data 504 may be specified for a targeted pixel 82 and/or a targeted region of the display 18. The example described herein focuses on the target pixel 82 compensation example, however it should be understand that each operation described may be performed for any suitable granularity of compensation (e.g., regional, entire display, per-pixel) or the like.

The anchor points 502 may define one or more compensations for a pixel 82. In this way, for the pixel 82, when the input image data 504 equals any of one or more defined input image data values, the anchor points 502 specify what compensation to apply to the input image data 504. However, when the input image data 504 does not match one of the defined input image data values, the anchor points 502 may be interpolated to derive a compensation (e.g., estimated compensation) to apply to the input image data 504 based on the other defined compensations. Thus, the anchor points 502 may provide a structured method in which to estimate a suitable and/or reasonable compensation to apply to a known input image data 504 when the input image data 504 is not specifically defined via the anchor point 502.

Similar to previous discussions associated with map selection, anchor points 502 of the pixel 82 may also change or be relatively less suitable at different brightness values. To counteract this, multiple ΔV maps of anchor points 502 corresponding to different brightness values may be defined during manufacturing.

Figure 23:
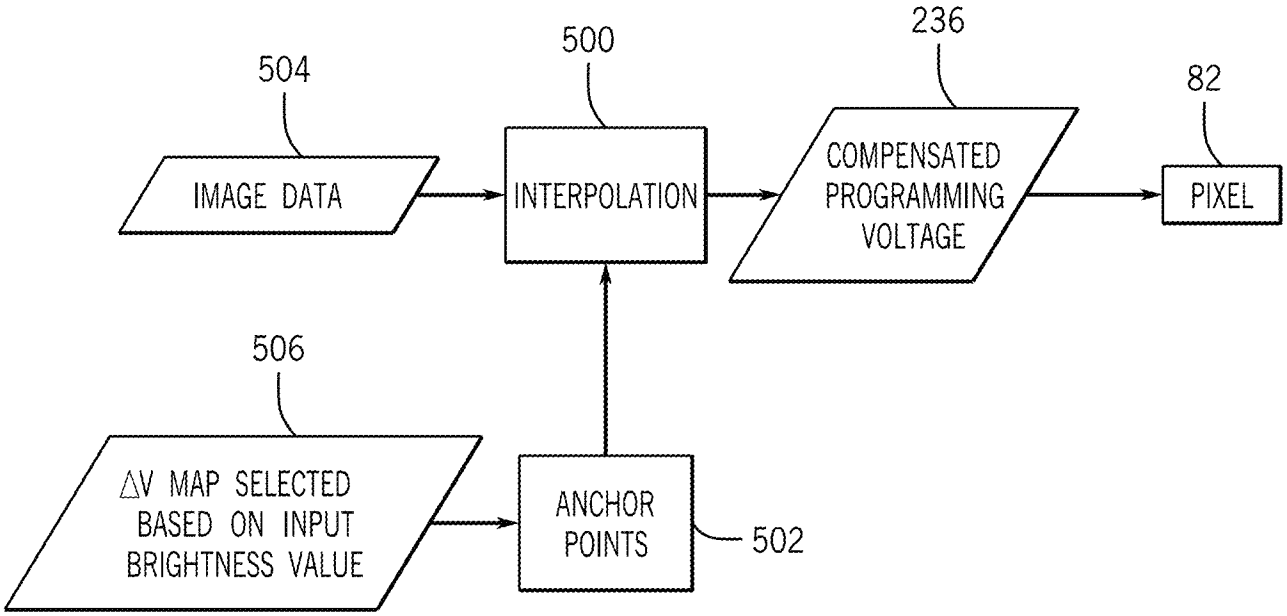
FIG. 23 is a block diagram representing using interpolation based on a brightness value to obtain a compensated data signal used to drive the pixel of FIG. 6 to compensate for pixel non-uniformity, in accordance with an embodiment.

FIG. 23 is a block diagram illustrating using interpolation 500 to obtain a compensated data signal (e.g., compensated programming voltage 236) used to drive the pixel 82 to compensate for pixel non-uniformity of the display 18. Here, many operations are repeated from FIG. 22 (and thus descriptions are relied upon herein), however the anchor points 502 are derived from a ΔV map 506 (e.g., a ΔV map similar to ΔV map 374 but including anchor points 502) selected based on the input brightness value 368. This improves the compensation operations because the ΔV map 506 is selected in response to actual operating conditions (e.g., current input brightness value 368), permitting the suitable data for the corresponding operational range 354 to be applied to the pixels 82.

Figure 24:
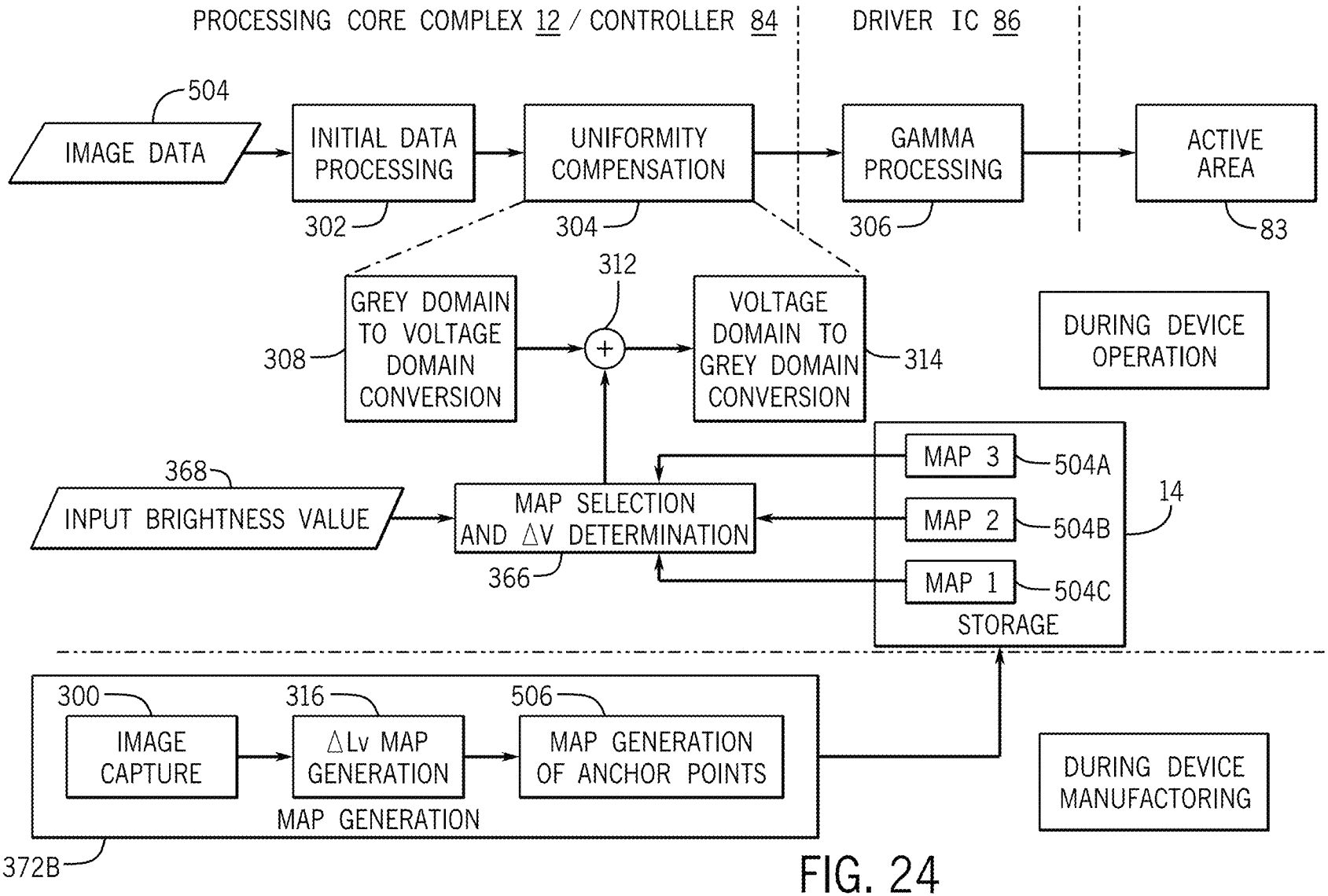
FIG. 24 is a block diagram representing using interpolation based on the brightness of the display to obtain a compensated data signal used to drive the pixel of FIG. 6 to compensate for pixel non-uniformity, in accordance with an embodiment.

To help elaborate, FIG. 24 is a block diagram illustrating using interpolation based on the brightness of the display and ΔV maps 506 to obtain a compensated programming voltage 236. FIG. 24 includes the map selection operation 366, where the controller 84 determines and selects a ΔV map 506 from multiple ΔV maps 506 (506A, 506B, 506C) based on an input brightness value 368. Similar operations between FIG. 17 and FIG. 24 are not additionally described, and thus descriptions from FIG. 17 are relied upon herein. It is noted that these operations may be performed by any suitable processing circuitry of the electronic device 10, including the processing core complex 12, the controller 84, a display pipe, a display pipeline, or the like.

During manufacturing of the electronic device 10, when calibration operations are performed, multiple image capture operations 300 may be performed at different brightness levels (e.g., different luminance of capture levels). Any suitable number of brightness levels and image capture operations 300 may be performed and one or more of the resulting images may be used to generate ΔV maps of anchor points 502 via a map generation of anchor points operation (shown as ΔV maps 506). Each image capture operation 300, and resulting ΔV map 506, may correspond to one of the operational ranges 354 described in FIG. 16. In this way, after receiving the input brightness value 368, the controller 84 may select a ΔV map 506 and an operational range 354 that includes the input brightness value 368 via map selection operations 366. The selected ΔV map 506 include anchor points 502 referenceable by the controller for interpolation and to determine the compensated programming voltage 236.

In this way, the controller 84 may receive image data 504 for presentation and perform initial data processing operations 302 on the image data 504. Using processed image data output from the initial data processing operations 302, the controller 84 may perform uniformity compensation operations 304 that include a grey domain to voltage domain conversion 308 and adding resulting voltage domain image data to a determined compensation value to generate the compensated programming voltage. The determined compensation value may be an output from the map selection and ΔV determination operation 366 since the controller 84 may use the selected ΔV map 506 during interpolation to determine an amount to compensate. The determined compensated value may be an analog offset voltage determined via map selection and anchor point interpolation operations. The determined compensation value may be summed with the voltage domain image data output from the grey domain to voltage domain conversion operations 308 to obtain the compensated programming voltage 236. The compensated programming voltage 236 may be converted back into the grey domain via voltage domain to grey domain conversion operations 314, and may be further processed via gamma processing 306 before being transmitted to one or more pixels 82 of the active area 83.

Figure 25:
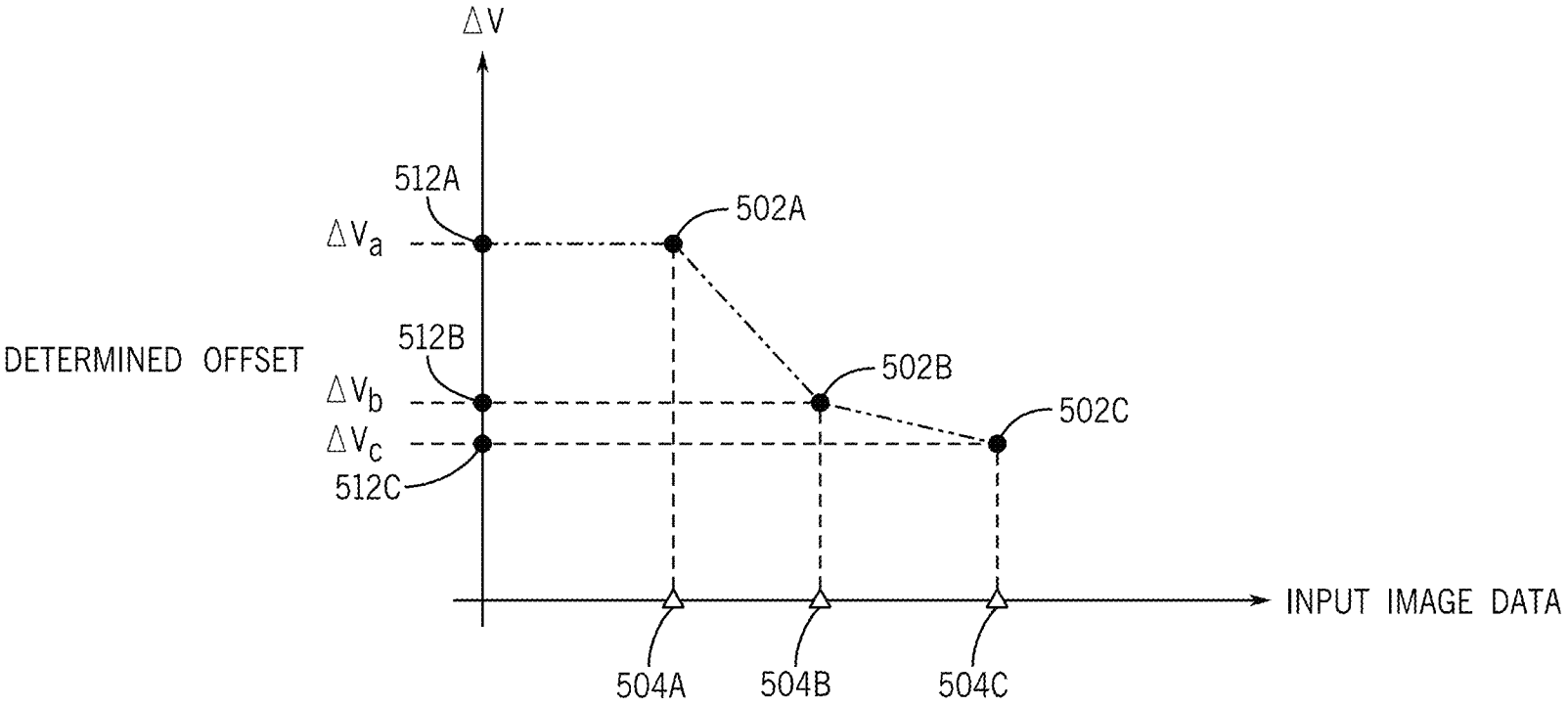
FIG. 25 is a graph of a comparison of driving voltage to resulting compensation to generate a compensated data signal according to anchor points corresponding to a pixel of the display of FIG. 5, in accordance with an embodiment.

Each map 506 may include one or more anchor points used to describe a brightness and voltage relationship corresponding to a pixel 82, or a region of pixels 82. To help elaborate, FIG. 25 is a graph depicting anchor points 502 as defined by a relationship between driving voltages (e.g., input image data 504) and resulting compensations used to generate a compensated programming voltage 236. Anchor points 502A, 502B, 502C may each be derived from a performance of the pixel 82 in response to test image data. The anchor points 502 associate an input image data 504 amount to an amount of offset (e.g., ΔV 512) to apply to input data to cause the output of the pixel 82 to improve in its uniformity. For example, the controller 84 performing the uniformity compensation operations 304 of FIG. 24 may receive the input image data 504A and determine directly from the anchor point 502A stored in memory to apply the offset of ΔV 512A to the input image data 504A to generate suitably compensated programming voltage 236. Any suitable number of anchor points 502 may be stored per-pixel and/or per-region. When the controller 84 cannot match the input image data 504 to an anchor point 502, the controller 84 may perform an interpolation to predict a suitable offset to apply to the input image data 504A.

Figure 26:
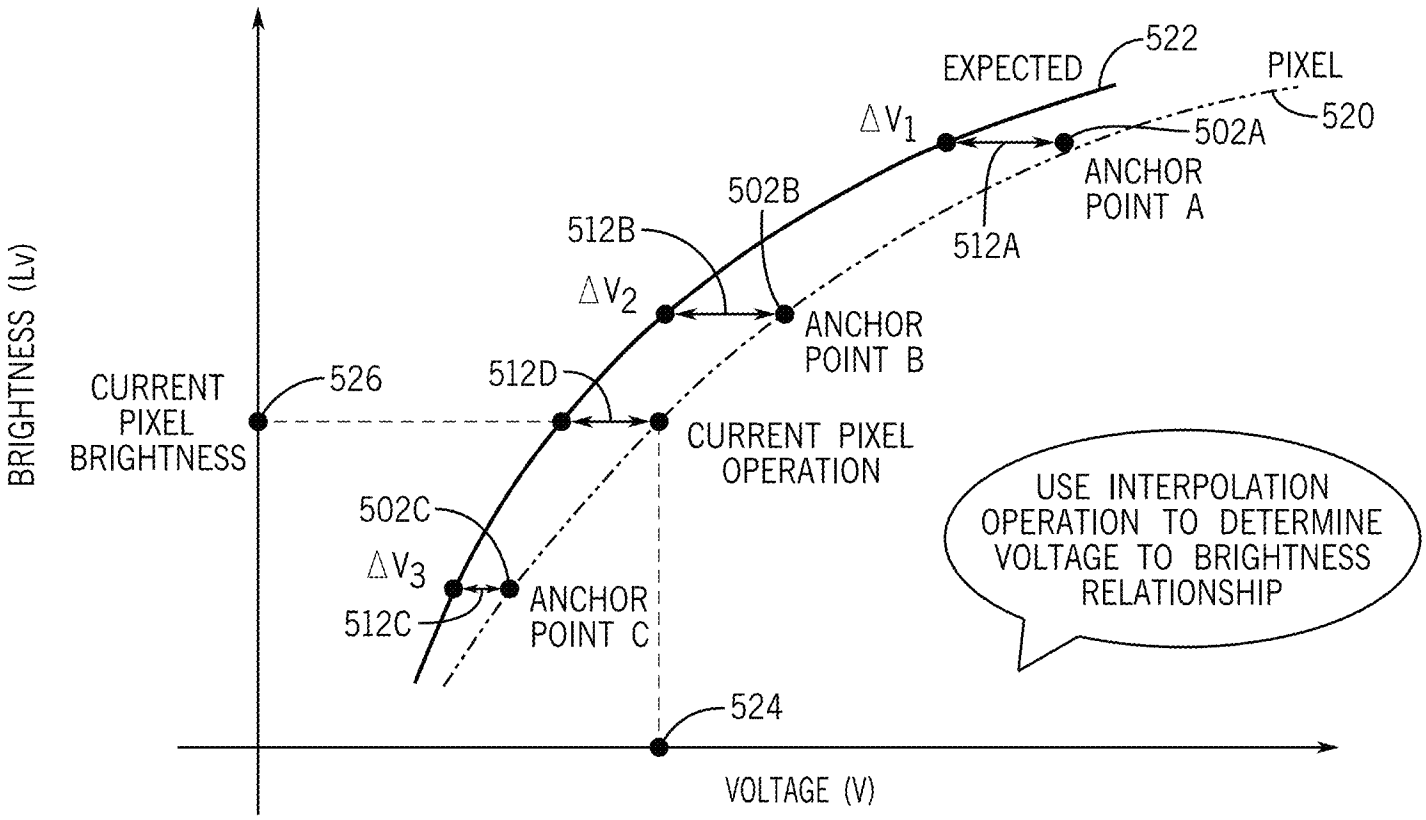
FIG. 26 is a graph of Lv-V curves corresponding to a pixel of the display of FIG. 5 and a desired or expected Lv-V curve for the pixel post-compensation based on interpolation, in accordance with an embodiment.

Explaining the interpolation further, FIG. 26 is a graph of Lv-V curves corresponding to a pixel 82 (e.g., line 520) and corresponding to an expected response for the pixel 82 post-compensation based on interpolation (e.g., line 522). As is shown, the pixel 82 is to be driven via image data 504 at a voltage 524 that does not equal a voltage of one of the anchor points 502. The voltage 524 may be a value between the voltages of anchor point 502B and anchor point 502C. Since the offset is not known or not referenceable for the voltage 524 (unlike how the offset is referenceable by the controller 84 for each of the anchor points 502), an interpolation may be performed to the offset of the anchor point 502B (e.g., ΔV 512B) and to the offset of the anchor point 502C (e.g., ΔV 512C) to determine a suitable offset for the voltage 524 (e.g., ΔV 512D). Once the offset of ΔV 512D is applied to the voltage 524, the pixel 82 may emit at a suitable brightness level 526 that aligns with the expected response for the pixel 82 (e.g., line 104). Although depicted as lines, it should be understood that portions or a subset of data points of the lines 520, 522 may be stored as anchor points 502.

Figure 27:
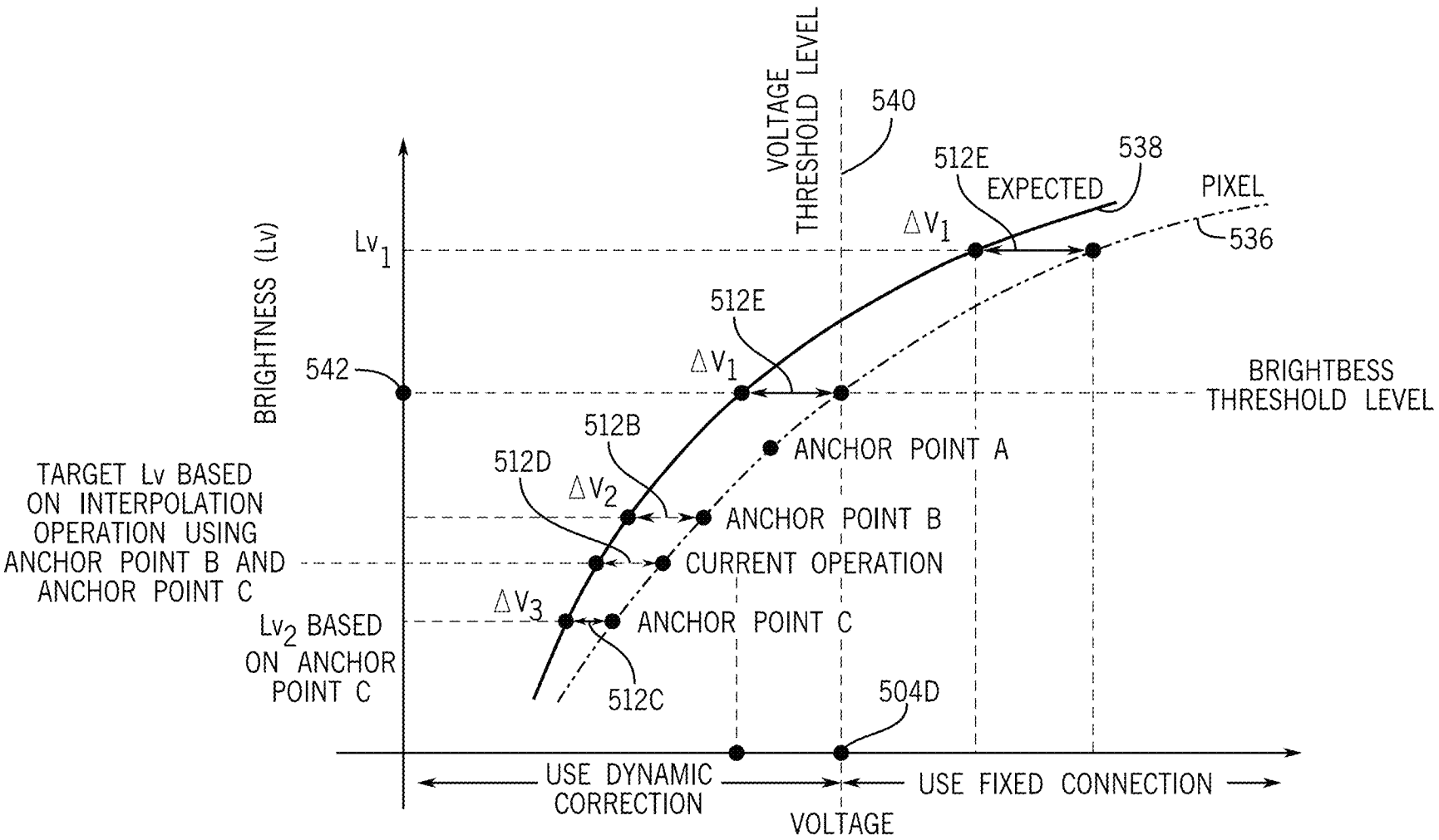
FIG. 27 is a graph of Lv-V curves corresponding to a pixel of the display of FIG. 5 and a desired or expected Lv-V curve for the pixel post-compensation based on interpolation and a brightness threshold defining when to use a fixed correction, in accordance with an embodiment.

In some examples, a compensation technique using a combination of a fixed correction and a dynamic correction may be applied by the controller 84. FIG. 27 is a graph of an Lv-V curve of a first pixel 82 (e.g., line 536) and an Lv-V curve associated with an expected response of a pixel 82 to various programming voltages (e.g., line 538). Although depicted as lines, it should be understood that portions or a subset of data points of the lines 536, 538 may be stored as anchor points 502.

The controller 84 may use a combination of techniques to determine a programming voltage based on a threshold. The controller 84 may apply a certain technique for input image data 504 below a threshold, such as a threshold value of image data 504D (e.g., line 540 but corresponding to a brightness threshold value 542), and may apply a different technique for input image data 504 above or at the threshold. For example, the controller 84 may apply a fixed offset of ΔV 512E for input image data 504 at or above the threshold (e.g., line 540) but may use dynamic correction techniques for input image data 504 less than the threshold (e.g., line 540). It should be understood that the threshold (e.g., line 540) may equal any suitable input image data value and correspond to any suitable brightness level and/or that any number of thresholds may be used to control the compensation technique used for various target brightness levels. Using a combination of techniques may lessen processing resources while maximizing benefits from using the anchor points 502 for input image data 504 less than the threshold (e.g., line 540) and minimizing processing resources dedicated to input image data 504 above or at the threshold (e.g., line 540) where a fixed correction may be a suitable form of correction to apply.

Figure 28:
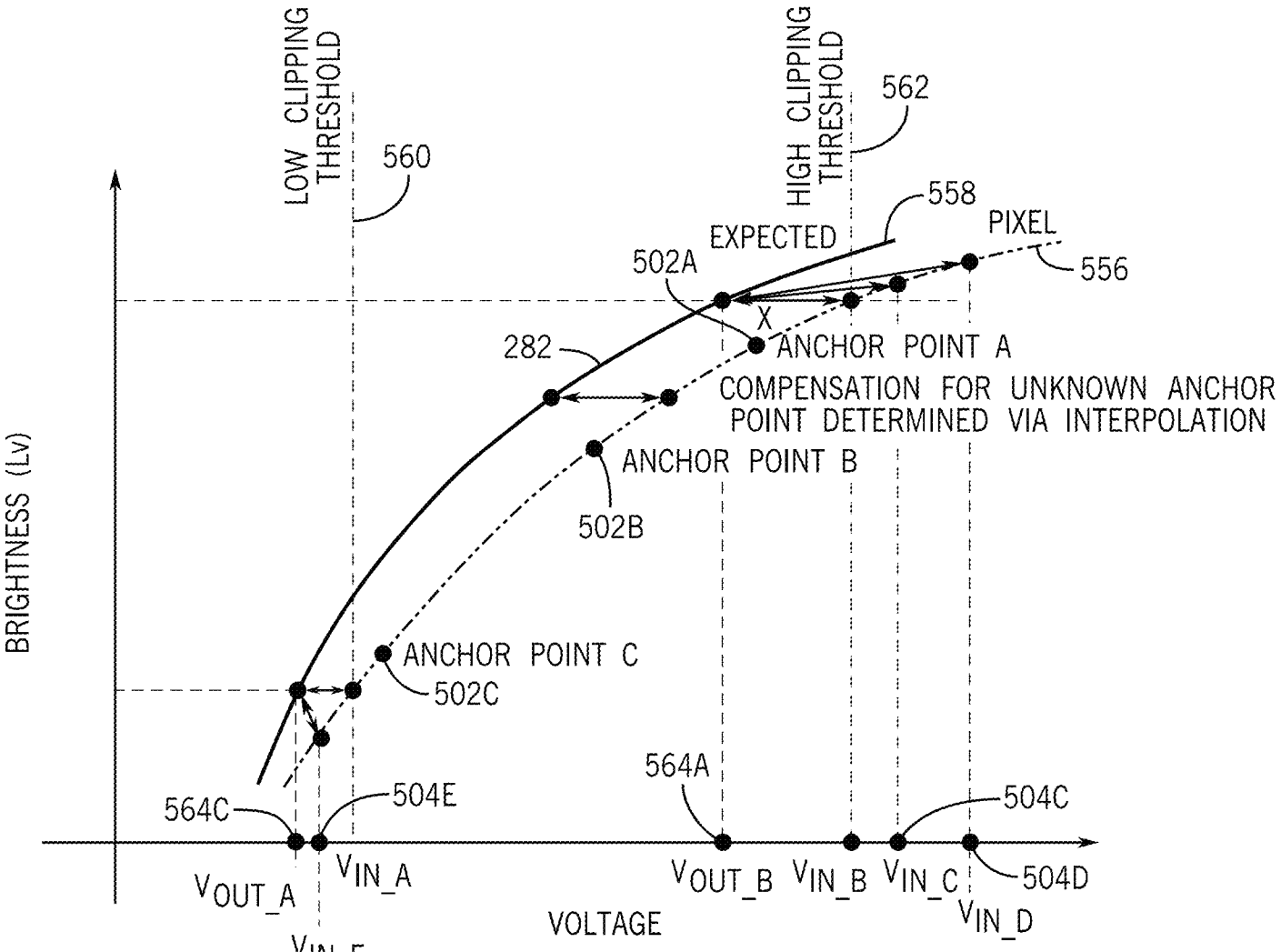
FIG. 28 is a graph of Lv-V curves corresponding to a pixel of the display of FIG. 5 and a desired or expected Lv-V curve for the pixel post-compensation based on interpolation and clipping thresholds that define when to use a fixed output correction, in accordance with an embodiment.

In yet another case, FIG. 28 is a graph of an Lv-V curve of a first pixel 82 (e.g., line 556) and an Lv-V curve associated with an expected response of a pixel 82 to various programming voltages (e.g., line 558). Although depicted as lines, it should be understood that portions or a subset of data points of the lines 556, 558 may be stored as anchor points 502. Clipping thresholds are also included on the graph and are thresholds where, for input image data 504 either above or below the clipping threshold, the input image data is uniformly compensated to emit at a same brightness.

A low clipping threshold 560 and a high clipping threshold 562 may be used to define an input image data range via the anchor points 502. In this way, when input image data 504 is received that is greater than the high clipping threshold 562, the input image data 504 is compensated to a clipped voltage 564A, regardless of the amount by which the input image data 504 is greater than or equal to the high clipping threshold 562 (e.g., a value greater than the high clipping threshold 562 is adjusted to equal a uniform compensated programming voltage). Furthermore, when the input image data 504 is less than or equal to the low clipping threshold 560, the input image data is compensated to a clipped voltage 564B, regardless of the amount by which the input image data 504 is less than the low clipping threshold 560 (e.g., a value less than the low clipping threshold 560 is adjusted to equal a uniform compensated programming voltage). For example, input image data 504C and the input image data 504D may both exceed the high clipping threshold 562 and thus are both respectively compensated to (e.g., clipped to) the clipped voltage 564B. As a second example, input image data 504E may be clipped to clipped voltage 564C since the input image data 504E is less than the low clipping threshold 560. Clipping may be permitted because differences in light emission at either relatively low or relatively high nits is unperceivable to a viewer, thus reducing an amount of processing resources used during the compensation.

Figure 29:
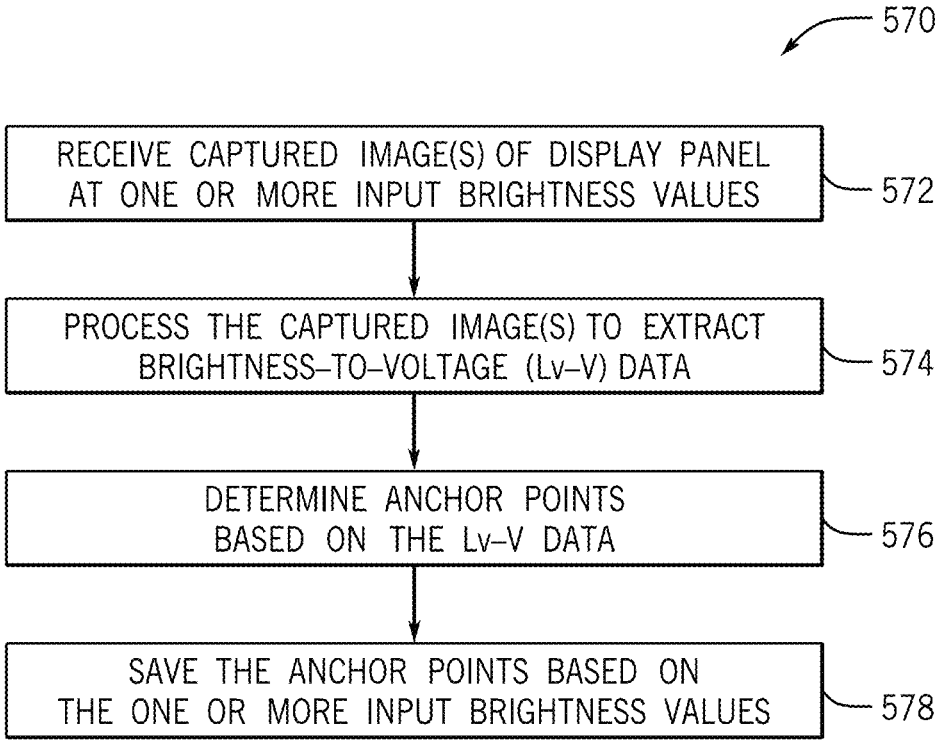
FIG. 29 is a flowchart of a process for generating the maps of FIG. 24, in accordance with an embodiment.

To help explain these operations described, FIG. 29 is a flowchart of an example process 570 for generating the ΔV maps 506 and for determining anchor points to be later used in dynamic correction techniques (e.g., where the map 504 is selected based on dynamic or real-time operating conditions). The process 570 includes receiving captured images of the display panel at one or more input brightness values (block 572), processing the captured images to extract brightness-to-voltage (Lv-V) data (block 574), determining anchor points based on the Lv-V data (block 576), and saving the anchor points based on the one or more input brightness values (block 578). It should be understood that, although the process 570 is described herein as being performed by the controller 84, any suitable processing circuitry, such as the processing core complex 12 or additional processing circuitry internal or external to the display 18, may perform all or some of the process 570. It should also be understood that the process 570 may be performed in any suitable order, including an order other than the order described below, and may include additional steps or exclude any of the described steps below. It is also noted that in some cases, some or all of these operations may be performed during manufacturing or at a time of display 18 and/or electronic device 10 calibration. For example, some or all of the process 570 may be represented via map generation operations 372B of FIG. 24.

At block 572, the controller 84 may receive one or more captured images of a panel of a display 18. These images may be captured during a calibration and/or testing period, where test image data is used to determine compensations to apply to the display 18 being tested. Operations performed at block 572 may be similar to operations of block 412 of FIG. 20, and thus are relied upon herein.

After receiving the one or more images, at block 574, the controller 84 may process the one or more images to extract Lv-V data for each captured image corresponding to differing operational ranges 354. The controller 84 may process the received images to determine the response of one or more of the pixels 82 to the test data that is the same but applied at different input brightness values. Operations performed at block 574 may be similar to operations of block 414 of FIG. 20, and thus are relied upon herein.

At block 576, the controller 84 may use the Lv-V data for each captured image to determine anchor points for each of the one or more pixels 82 characterized by the Lv-V data. In this way, the controller 84 may determine anchor points 502 for regional groupings of pixels 82, for each pixel 82 of the active area 83, or for any suitable combination of pixels 82 of the display 18. The data stored as the anchor point 502 may be an input image data value and a corresponding adjustment for the input image data value. Using a per-pixel defined anchor point 502 as an example, the controller 84 may determine the adjustment to be stored as part of the anchor point 502 by comparing an identified behavior of a target pixel 82 to a desired behavior for each pixel 82 (e.g., a uniform behavior). In this way, the controller 84 may compare a brightness at which a target pixel 82 is to emit in response to the input image data value to an average emission behavior of the display 18 at the input image data value. The difference between the brightness level of the target pixel 82 and the desired brightness level may be correlated into a desired input image data value using the Lv-V data. A difference between the desired input image data value and the input image data value used to determine the desired input image data value may be used as an offset value to apply to input image data values received at a later time during actual operation of the electronic device 10. The controller 84 may determine offset values and/or adjustments to be stored with the input image data value as the anchor point using any suitable method.

Once the anchor points 502 are determined for each input brightness value (e.g., each captured image), at block 578, the controller may store the anchor points 502 in memory. The controller 84 may store the anchor points 502 as part of ΔV maps 504, organized by input brightness values. The ΔV maps 504 may each include a parameter, such as a variable stored in a field, that specifies which input brightness level each ΔV map 504 corresponds to. The controller 84 may reference these fields when performing map selection operations 366 of FIG. 24.

Figure 30:
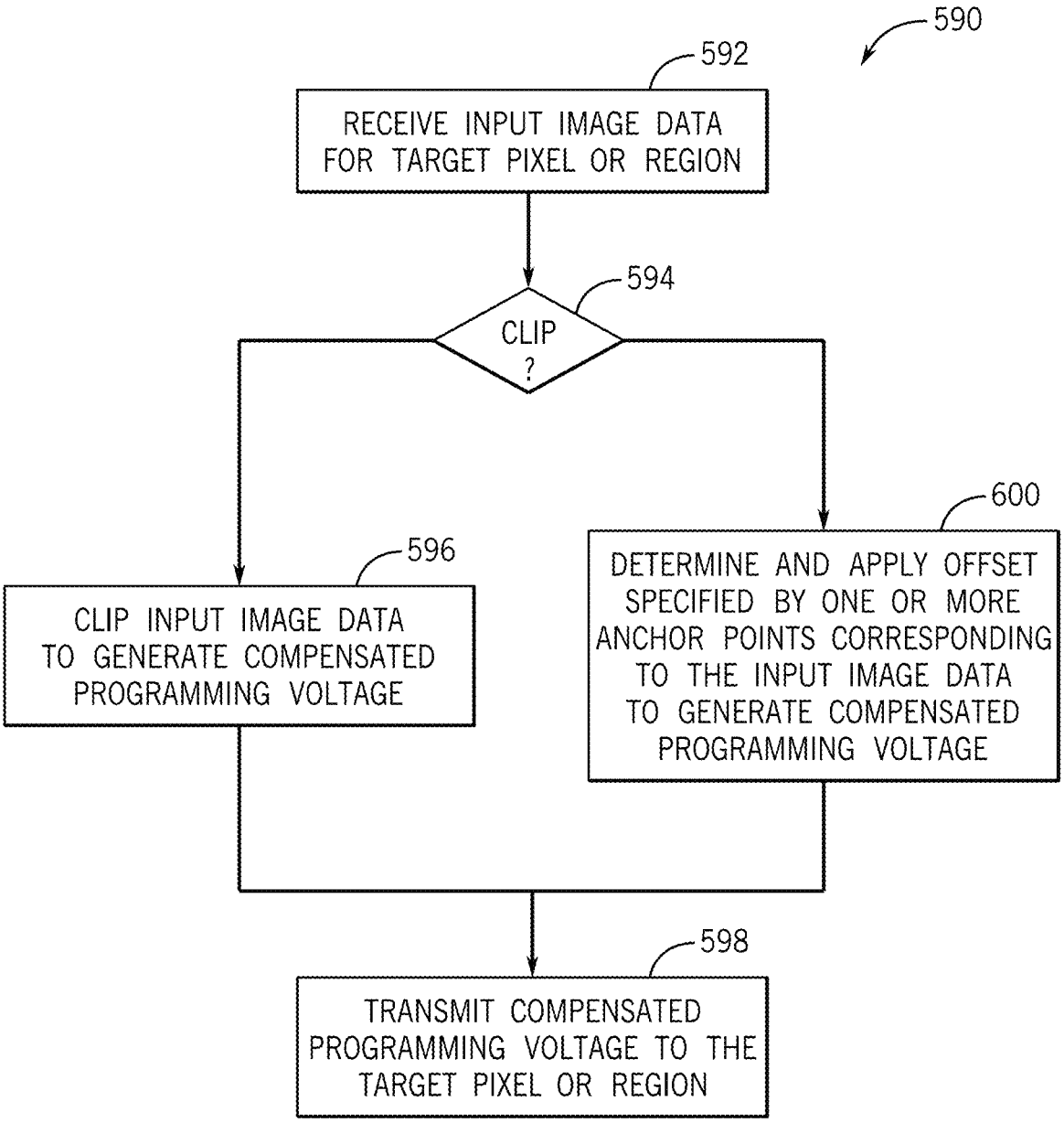
FIG. 30 is a flowchart of a process for using interpolation to compensate for pixel non-uniformities based on an input brightness value, in accordance with an embodiment.

FIG. 30 is a flowchart of a process 590 for using interpolation to compensate for pixel non-uniformities based on an input brightness value. The process 590 includes determining a target brightness level for a pixel to emit light at based on image to be displayed and/or based on an input brightness value (block 592) and determining whether to apply clipping (block 594). In response to determining to clip, the process 590 includes clipping a compensated programming voltage (block 596) and transmitting the compensated programming voltage to the pixel (block 598). However, in response to determining to not clip, the process 590 includes determining and applying an offset specified by one or more anchor points corresponding to input image data to generate a compensated programming voltage (block 600), and transmitting the compensated programming voltage to the pixel (block 598). It should be understood that, although the process 590 is described herein as being performed by the controller 84, any suitable processing circuitry, such as the processing core complex 12 or additional processing circuitry internal or external to the display 18, may perform all or some of the process 590. It should also be understood that the process 590 may be performed in any suitable order, including an order other than the order described below, and may include additional steps or exclude any of the described steps below.

At block 592, the controller 84 may receive input image data 504 to be used to generate driving signals to drive the pixel 82. The input image data 504 may correspond to target brightness level 230 or a target gray level associated with a portion of the image data assigned to the pixel 82.

At block 594, the controller 84 determines whether to clip the input image data 504 to a particular value. To do so, the controller 84 may compare a value of the input image data 504 to one or more clipping thresholds (e.g., low clipping threshold 560, high clipping threshold 562). In response to determining that the value of the input image data 504 is either greater than a high clipping threshold 562 or less than a low clipping threshold 560, the controller may, at block 596, clip the input image data 504 to generate the compensated programming voltage 236. As described with regard to FIG. 28, the input image data 504 may be clipped to voltage 564A (if greater than the high clipping threshold 562) or to voltage 564C (if less than the low clipping threshold 560).

However, in response to determining that the value of the input image data 504 is not to be adjusted via clipping, the controller 84 may, at block 600, determine and apply an offset to the input image data 504 as specified by one or more anchor points 502. Each anchor point 502 may correspond to an input image data value and an offset value (e.g., ΔV 512), such that when the controller 84 receives input image data 504 equal to the input image data value, the controller 84 applies the offset value without performing additional operations related to determining a compensation. Sometimes two anchor points 502 may be used to determine an offset value if the input image data 504 does not equal one of the input image data values stored as anchor points 502. In these cases, the controller 84 may interpolate the two anchor points 502 to determine an offset valued between offset values associated with the two anchor points 502.

At block 600, the controller 84 may transmit the generated compensated programming voltage 236 to pixel 82. Driving the pixel 82 with the compensated programming voltage 236 may cause the pixel 82 to emit a uniform brightness level relative to other pixels 82 also emitting according to a same target brightness level (e.g., target grey level defined by image data).

Figure 31:
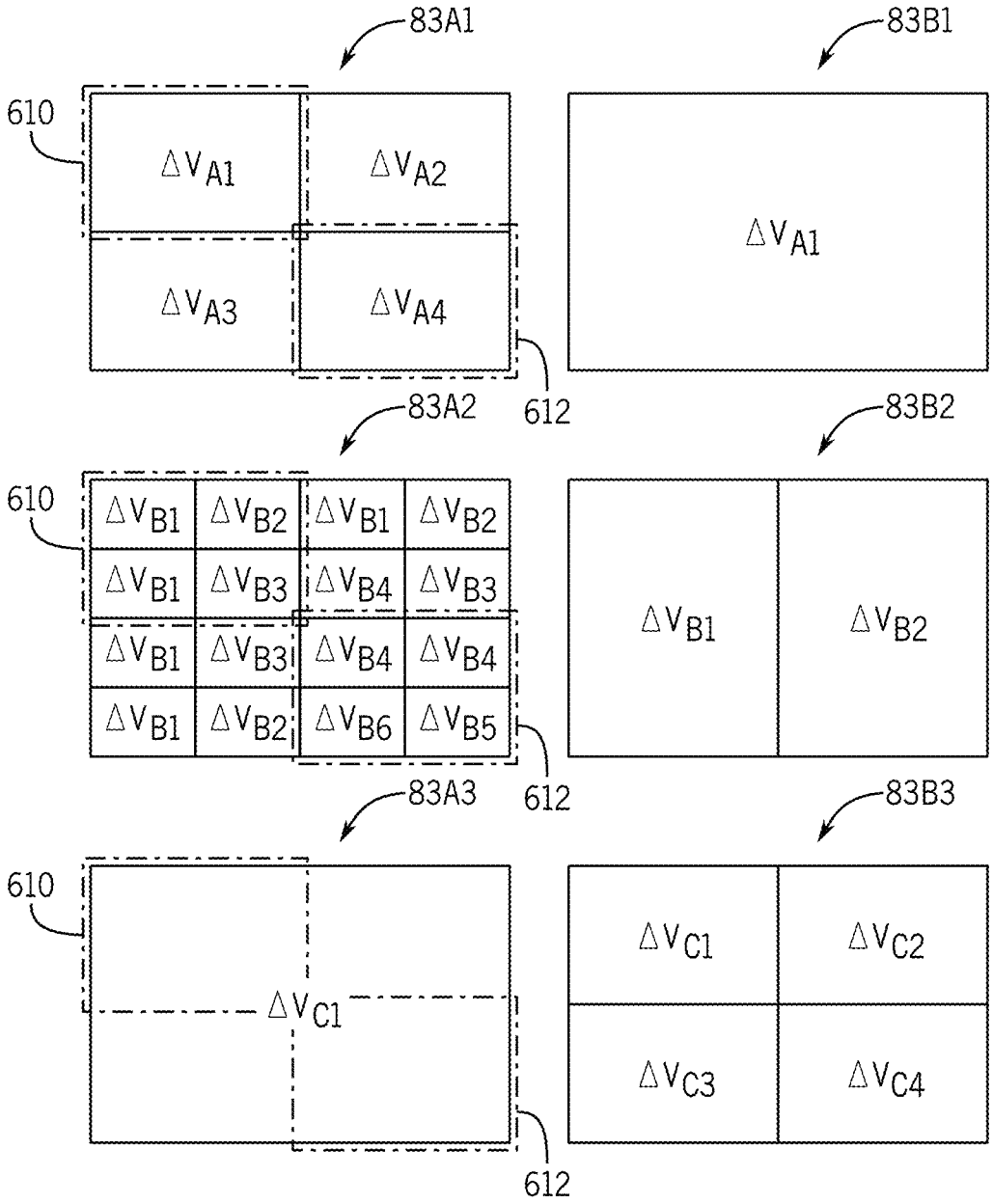
FIG. 31 is an illustration of regional compensations used with interpolation operations to compensate for pixel non-uniformities, in accordance with an embodiment.

As described above, the controller 84 may apply regionally-specific compensations. FIG. 31 is an illustration of regional compensations used with interpolation operations to compensate for pixel non-uniformities. The active area 83 may have different regional definitions of anchor points 502. For example, the active area 83A may use three anchor points for each pixel 82, and thus three ΔV 512 offsets, per regional definition (e.g., each pixel within the active area 83A share a certain number of ΔV 512 offsets values based on location within the active area 83A). The active area 83A may share offsets between regional definitions. For example, regional definition 610 is associated with some shared offsets and some unique offsets, relative to other regional definitions (e.g., regional definition 612) of the active area 83A. Regional definition 610 uses a same offset (e.g., $\Delta V_{B1}$, $\Delta V_{C1}$) for at least a portion of its region as the regional definition 612 but also uses many different offsets (e.g., $\Delta V_{A1}$, $\Delta V_{B2}$, $\Delta V_{B3}$). Offset $\Delta V_{C1}$ may be said to be a globally defined offset since the entire active area 83A is adjusted according to it. Active area 83B provides an additional example of regional definitions and offset overlap. As a reminder, each of the offsets may be stored as an anchor point to improve compensation operation by reducing an amount of memory used to store per-pixel definitions and/or by increasing a speed of compensations.

Thus, the technical effects of the present disclosure include improving controllers of electronic displays to compensate for non-uniform properties between one or more pixels or groups of pixels, for example, by applying a per-pixel function to programming data signals used in driving a pixel to emit light. These techniques describe selectively generating a compensated data signal (e.g., programming voltage, programming current, programming power) based on a per-pixel function, where the compensated data signal is used to drive a pixel to emit light at a particular brightness level to account for specific properties of that pixel that are different from other pixels. These techniques may be further improved by generating compensated data signals with consideration for an input brightness value. By selecting a map based on the input brightness value, non-uniform properties of the display that manifest as visual artifacts may be reduced or mitigated. Different maps may be generated at a time of calibration and/or manufacturing by repeating, at different brightness values, generation of extracted parameters for multiple image captures as a way to gather information about how each pixel behaves when driven to present at different brightness values in addition to different image data. Maps may be generated to include per-pixel functions and/or to include anchor points. Furthermore, using anchor points to provide a compensated data signal may decrease an amount of time for compensation operations and/or may reduce an amount of memory used to store information used in the compensation.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A system comprising:

an electronic display panel comprising a plurality of pixels configured to emit light based on respective programming signals;

a memory configured to store a plurality of maps of sets of variables that define respective pixel brightness-to-data relationships for different pixels of the plurality of pixels when input into a function; and processing circuitry configured to:

receive a global brightness value of the electronic display panel;

select one of the plurality of maps based at least in part on the global brightness value;

determine a gray level value upon which the respective programing signal for a first pixel of the plurality of pixels is based;

retrieve a first set of variables from the selected map that corresponds to the first pixel;

input the first set of variables into the function to obtain a pixel brightness-to-data relationship for the first pixel; and determine an adjustment for the gray level value of the first pixel based at least in part on the pixel brightness-to-data relationship for the first pixel.

2. The system of claim 1, wherein the function is specific to each pixel.

3. The system of claim 2, wherein the function comprises a linear regression, a power law model, an exponential model, or some combination thereof.

4. The system of claim 1, wherein each pixel comprises a light-emitting diode (LED).

5. The system of claim 1, wherein the function is specific to a subset of the plurality of pixels.

6. The system of claim 1, wherein each pixel comprises a digital micromirror device (DMD).

7. The system of claim 1, wherein the electronic display panel is configured as a liquid crystal display (LCD).

8. The system of claim 1, wherein the sets of variables of the plurality of maps are determined based at least in part on captured image data indicating brightness levels of light emitted by the plurality of pixels in response to test image data and a brightness level.

9. The system of claim 8, wherein the captured image data corresponding to the selected map comprises three captured images each captured at the brightness level corresponding to the global brightness value.

10. A method for compensating for non-uniformities of an electronic display, comprising:

determining, using processing circuitry, a plurality of maps of sets of variables that define respective pixel brightness-to-data relationships for different pixels of a plurality of pixels when input into a function;

storing, using the processing circuitry, the plurality of maps with respective indications of respective global brightness values;

receiving, using the processing circuitry, image data to be displayed on the electronic display via at least a first pixel and an indication of a global brightness value;

selecting, using the processing circuitry, one of the plurality of maps based at least in part on the indication of the global brightness value;

retrieving, using the processing circuitry, a first set of variables from the selected map that corresponds to the first pixel;

inputting, using the processing circuitry, the first set of variables into the function to obtain a pixel brightness-to-data relationship for the first pixel;

determining, using the processing circuitry, an adjustment for a gray level value of the image data based at least in part on the pixel brightness-to-data relationship for the first pixel;

adjusting the gray level value with the adjustment; and generating, using the processing circuitry, the programming signal based at least in part on the adjusted gray level value.

11. The method of claim 10, wherein the function comprises a linear regression, a power law model, an exponential model, or some combination thereof.

12. The method of claim 10, wherein the one or more sets of variables are generated based at least in part on captured image data configured to indicate a response of the first pixel to test image data.

13. The method of claim 10, wherein determining the programming signal for the first pixel comprises a calculation based at least in part on a proportion relating the gray level value to the programming signal.

14. The method of claim 10, wherein determining the one or more variables comprises:

receiving, using the processing circuitry, one or more captured images generated in response to test data;

extracting, using the processing circuitry, brightness-to-voltage (Lv-V) data from the one or more captured images;

determining, using the processing circuitry, the one or more sets of variables based at least in part on fitting the function to the brightness-to-voltage (Lv-V) data; and associating the one or more sets of variables with one or more global brightness values corresponding to the one or more captured images.

15. The method of claim 10, comprising referencing, using the processing circuitry, a look-up table to determine the one or more sets of variables for the first pixel to apply to the function, wherein the referencing of the look-up table at least in part involves matching an input operating condition to an operational range associated with the one or more sets of variables.

* * * * *